US008152982B2

(12) United States Patent
Purdy et al.

(10) Patent No.: US 8,152,982 B2
(45) **Date of Patent: *Apr. 10, 2012**

(54) COATING LINE AND PROCESS FOR FORMING A MULTILAYER COMPONENT COATING ON A SUBSTRATE

(76) Inventors: Sean Purdy, Cincinnati, OH (US); Dennis A. Simpson, Sarver, PA (US); Richard J. Foukes, Mars, PA (US); David M. Aiken, Freedom, PA (US); James P. Rowley, Freeport, PA (US); Leigh Ann Humbert, Pittsburgh, PA (US)

( * ) Notice: Subject to any disclaimer, the term of this patent is extended or adjusted under 35 U.S.C. 154(b) by 260 days.

This patent is subject to a terminal disclaimer.

(21) Appl. No.: 12/394,086

(22) Filed: Feb. 27, 2009

(65) Prior Publication Data

US 2009/0173633 A1 Jul. 9, 2009

Related U.S. Application Data

(62) Division of application No. 10/366,222, filed on Feb. 13, 2003, now Pat. No. 7,531,074.

(51) Int. Cl.
*C25D 13/12* (2006.01)
*B05D 1/36* (2006.01)

(52) U.S. Cl. ..... 204/488; 204/501; 204/509; 427/407.1; 427/409

(58) Field of Classification Search ..... 204/488, 204/501, 509; 427/407.1, 409
See application file for complete search history.

(56) References Cited

U.S. PATENT DOCUMENTS 5,871,827 A * 2/1999 Jaffe et al. ..... 428/29
6,291,018 B1 * 9/2001 Dattilo ..... 427/377

FOREIGN PATENT DOCUMENTS

EP 899314 A1 * 3/1999

* cited by examiner

*Primary Examiner* — Kishor Mayekar
(74) *Attorney, Agent, or Firm* — Steven W. Hays; Diane R. Meyers

(57) ABSTRACT

A process for forming a multilayer composite coating on a substrate is provided. The process includes forming an electrodeposition coating layer on the substrate by electrodeposition of a curable electrodepositable coating composition over at least a portion of the substrate. Optionally, the coated substrate is heated to a temperature and for a time sufficient to cure the electrodeposition coating layer. A basecoating layer is formed on the electrodeposition coating layer by depositing an aqueous curable basecoating composition directly onto at least a portion of the electrodeposition coating layer. Optionally, the basecoating layer is dehydrated. A top coating layer is formed on the basecoating layer by depositing a curable top coating composition which is substantially pigment-free directly onto at least a portion of the basecoating layer. The top coating layer, the basecoating layer, and, optionally, the electrodeposition coating layer are cured simultaneously.

53 Claims, 2 Drawing Sheets

COATING LINE AND PROCESS FOR FORMING A MULTILAYER COMPONENT COATING ON A SUBSTRATE

CROSS REFERENCE TO RELATED APPLICATION

This application is a divisional application of U.S. application Ser. No. 10/366,222 filed Feb. 13, 2003 now U.S. Pat. No. 7,531,074, filed May 12, 2009, and titled "Coating Line And Process For Forming A Multilayer Composite Coating On A Substrate", which is hereby fully incorporated by reference.

FIELD OF THE INVENTION

The present invention relates to a process for forming a multilayer composite coating on a substrate, particularly an automotive vehicle substrate, and a coating line wherein the process is employed.

BACKGROUND OF THE INVENTION

Multilayer composite coatings, for example, color-plus-clear coating systems, involving the application of a colored or pigmented basecoat to a substrate followed by application of a transparent or clearcoat over the basecoat, have become increasingly popular as original finishes for a number of consumer products including, for example, automotive vehicles. The color-plus-clear coating systems have outstanding appearance properties such as gloss and distinctness of image, and provide excellent coating systems such as corrosion resistance, scratch and abrasion resistance, and resistance to deleterious environmental conditions such as acid rain. Such color-plus-clear coating systems have become popular for use on automotive vehicles, aerospace substrates, floor coverings such as ceramic tiles and wood flooring, packaging materials and the like.

A conventional automotive coating process typically includes the sequential application of an electrodepositable coating composition, usually a cationic composition, a primer-surfacer coating composition over the electrodeposition coating, a color-enhancing and/or effect-enhancing basecoating composition over the primer-surfacer coating, and a transparent or clear coating composition over the basecoat. In some instances, the electrodeposition coating is applied over a mill-applied weldable, thermosetting coating which has been applied to the coiled steel metal substrate from which the autobody (or autobody parts, such as fenders, doors, and hoods) are formed.

For example, as mentioned above, on most automotive coating lines, the auto body is first given an electrodeposition coating commonly formed from a cationic electrodepositable coating composition. This electrodeposition coating typically is then thermally cured. The electrodeposition coating must be fully adherent to the substrate and inhibits corrosion of the substrate to which it is applied. In conventional electrodeposition coatings, the excellent adhesion and corrosion resistance properties can be derived from the inclusion in the electrodepositable composition of ionic film-forming resins and/or crosslinking agents which can comprise aromatic moieties. While providing excellent adhesion and corrosion resistance, these resins and/or crosslinking agents can be susceptible to degradation by visible and/or ultraviolet light which can penetrate through the subsequently applied coating layers. Such photodegradation can result in delamination of the electrodeposition coating from the substrate, causing catastrophic failure of the multilayer composite coating system.

A primer-surfacer coating composition typically is applied to the cured electrodeposition coating, and the primer-surfacer coating is then thermally cured. The primer-surfacer coating composition usually comprises a polymer composition which provides a tough and flexible coating; and typically is heavily pigmented, for example, with filler pigments, such as talc and clay, and often contains photodegradation-resistant pigments, for example, carbon black. The cured primer-surfacer coating layer can have a film thickness as high as 100 micrometers, but usually between 25 and 50 micrometers. As such, the primer-surfacer coating can enhance chip resistance of the multilayer composite coating system, and also can mask any surface defects present in the electrodeposition coating, thereby ensuring a smooth appearance of the subsequently applied top coatings. Moreover, the primer-surfacer affords visible and ultraviolet light opacity to prevent photodegradation of the previously applied electrodeposition coating. One known primer-surfacer is GPX 45379 commercially available from PPG Industries, Inc. of Pittsburgh, Pa.

A basecoating composition, most often an aqueous composition, then is applied to the cured primer-surfacer coating. The basecoating composition usually contains color-enhancing and/or effect-enhancing pigments.

The basecoating is typically given a flash bake at a temperature and for a time sufficient to drive off excess solvents, but insufficient to cure the basecoating composition. A transparent or clear coating then is applied to the uncured basecoating. This is commonly referred to as a wet-on-wet application. The clear coat can provide excellent gloss and distinctive of image, as well as scratch and mar resistance, and resistance to harsh environmental conditions.

In one known coating line, the substrate is electrocoated at an electrocoating station and then is moved into a primer zone for application of the primer-surfacer. As described above, the primer-surfacer is typically a relatively thick coating to mask surface defects in the underlying substrate. The applied primer-surfacer layer is cured and then the cured primer-surfacer can be sanded to remove surface defects and to provide a smooth outer surface for the application of further coatings. However, this sanding process can result in small particles of grit or dirt that must then be brushed or tacked off of the substrate before further coatings can be applied. After this tacking process, the substrate is moved into a basecoating zone where the fully color-pigmented basecoat composition is applied onto the cut-in portions of the substrate. The same fully color-pigmented basecoat composition is applied onto the primer-surfacer over the exterior of the substrate at one or more subsequent basecoat stations. The applied basecoat compositions are then baked to pre-dry the basecoating, and a clearcoat composition is applied onto the basecoat on the substrate exterior. Typically, the clearcoat composition is not applied onto the basecoat in some areas in the cut-in portions.

Due to the resultant cost-savings, there has been recent interest in the automotive coatings market in reducing the cured film thickness of one or more of the coating layers in the multilayer composition coating, and/or eliminating one or more of the coating steps altogether. For example, in some multilayer coating processes the primer-surfacer coating application and curing steps can be eliminated. That is, the basecoating composition is applied directly onto the cured electrodeposition coating. In such modified coating processes, both the electrodeposition coating and the basecoating are required to meet stringent durability, appearance, and physical properties specifications.

Further, as previously mentioned, for some applications, a weldable, corrosion inhibitive primer coating is mill-applied to metallic substrates. The basecoating composition can then be applied directly to the cured weldable primer coating with no intervening electrodeposition coating and no primer-surfacer coating.

Also, automotive parts and accessories, for example non-metal or elastomeric autobody parts, such as bumpers and body side moldings, typically are coated "off site" and shipped to the automobile assemble plants. Such substrates do not require corrosion resistance as do the metallic substrates discussed above. Hence, the basecoating composition can be applied directly to the non-metal substrate surface, or, alternatively, to a previously applied intervening adhesion-promoting primer coating.

U.S. Pat. No. 6,221,949 B1 discloses a coating formulation for use in multicoat paint systems which comprises a water-dilutable polyurethane resin having an acid number of 10 to 60 and a number average molecular weight of 4000 to 25,000. The polyurethane is prepared by reacting a polyester and/or polyether polyol having a number average molecular weight of 400 to 5000 or a mixture of such polyesters and polyether polyols; a polyisocyanate or mixture thereof; a compound which has in the molecule at least one group reactive toward isocyanate groups and at least one group capable of forming anions or a mixture of such compounds; and optionally a hydroxyl and/or amino-containing organic compound having a molecular weight of from 40 to 400, and at least partially neutralizing the resulting reaction product. The composition further comprises pigments and/or fillers where the ratio of binder to pigment is between 0.5:1 to 1.5:1. In such compositions, the presence of talc is required in an amount of 20 to 80% by weight of the overall quantity of pigment. This composition is employed in a process for forming a multicoat paint system in which the substrate is coated with an electrodeposition coating which is optionally predried or baked, the composition described above is applied to the electrodeposition coating and optionally predried without baking, a second aqueous coating is applied to the coating formed from the previously described composition and optionally predried without baking, a transparent coating is applied to the coating formed from the second aqueous composition, and the overall paint system is baked.

U.S. Pat. No. 5,976,343 discloses a process for multicoat lacquering of a substrate with a stoved first electrodeposition layer by a applying a second surface coating layer having a dry thickness of 10 to 30 microns consisting of a base lacquering agent containing a first water-based polyurethane resin, and wet-on-wet application of a third coating agent with a dry layer thickness of 7 to 15 microns. The third coating layer consists of a second water-based lacquering agent containing a polyurethane resin. A clear lacquering layer is then applied without stoving of the third coating agent, and the multicoat system is stoved to mutually cure the second, third and clear lacquer layers. The first base lacquering agent has a higher concentration of polyurethane resin than does the second base lacquering agent. Further, the patent discloses that the first base lacquering agent is prepared from the second base lacquering agent by admixing an appropriate amount of polyurethane resin with the second base lacquering agent.

U.S. Pat. No. 4,820,555 discloses a method for forming a multicoat system on a substrate by first applying an electrocoating composition to a substrate and curing the electrocoating composition, applying a sealercoating composition over the electrocoat and, optionally, baking the sealercoating, applying a metallic basecoating composition over the sealercoating, either drying, flash-baking, or curing the metallic basecoating, applying a clearcoating composition over the metallic basecoating, and baking the multicoat system. The sealercoating composition can be solvent-based or water-based, and provides improved metallic pigment orientation, basecoat smoothness and adhesion.

In an attempt to alleviate some of the problems associated with known coating processes, another coating line has been developed in which primer-surfacer application has been eliminated. However, in this process the structure and operation of the coating line must be significantly altered in order to accommodate problems arising from this change. For example, in this process after application of the electrodeposition coating, a first basecoat composition is applied over the exterior surface of the substrate. This first basecoat composition is a chip resistant, color pigmented composition that can be color keyed to approximate the desired final color of the coated substrate. The first basecoat composition is then heated to pre-dry the first basecoat and a second basecoat composition of the desired final color pigmentation is applied onto the first basecoat composition on the exterior surface. The cut-in portions are coated with the second basecoat composition, between application of the first and second basecoating composition. This modification is required due to the color transition areas that would be visible if the cut-in portions were coated first, as in a typical coating process. However, this change in the coating sequence means that this process is not easily incorporated in existing coating lines that are set up to coat the cut-in portions of the substrate before the exterior portions. Added expense must be incurred to either build a new coating line to practice this process or to modify an existing line to move the cut-in application to the end of the basecoating zone.

In view of the foregoing, it would be advantageous to provide a process for forming a multilayer composite coating system which eliminates the application and curing of a primer-surfacer coating whereby a first basecoating composition can be applied directly to an electrodeposition coating, or, alternatively, to a treated or untreated substrate; followed by wet-on-wet application of a second color- or effect-enhancing basecoat, the composition of which can be the same or different from that of the first basecoating composition, with subsequent wet-on-wet application of a clearcoat. Further, it is desirable that such a multilayer composite coating system be applied on a conventional coating line without significant modification.

SUMMARY OF THE INVENTION

In one embodiment, the present invention is directed to a process for forming a multilayer composite coating on a substrate, the process comprising:

- forming an electrodeposition coating layer on the substrate by electrodeposition of a curable electrodepositable coating composition over at least a portion of the substrate;
- optionally, curing the electrodeposition coating layer;
- forming a basecoating layer on the electrodeposition coating layer by depositing an aqueous curable basecoating composition directly onto at least a portion of the electrodeposition coating layer,
- optionally, dehydrating the basecoating layer;
- forming a top coating layer on the basecoating layer by depositing a curable top coating composition which is substantially pigment-free directly onto at least a portion of the basecoating layer; and curing the top coating layer, the basecoating layer, and, optionally, the electrodeposition coating layer simultaneously.

In another embodiment, the present invention is directed to a process for forming a multilayer composite coating on a substrate, the process comprising:

forming an electrodeposition coating layer on the substrate by electrodeposition of a curable electrodepositable coating composition over at least a portion of the substrate;

optionally, curing the electrodeposition coating layer;

forming a first basecoating layer on the electrodeposition coating layer by depositing an aqueous curable first basecoating composition directly onto at least a portion of the electrodeposition coating layer, optionally, dehydrating the first basecoating layer;

forming a second basecoating layer on the first basecoating layer by depositing an aqueous curable second basecoating composition, which is the same or different from the first basecoating composition, directly onto at least a portion of the first basecoating layer, optionally, dehydrating the second basecoating layer;

forming a top coating layer on the second basecoating layer by depositing a curable top coating composition which is substantially pigment-free directly onto at least a portion of the second basecoating layer; and curing the top coating layer, the second basecoating layer, the first basecoating layer, and, optionally, the electrodeposition coating layer simultaneously.

The present invention also is directed to a process for forming a multilayer composite coating on a substrate, the process comprising:

forming an electrodeposition coating layer on the substrate by electrodeposition of a curable electrodepositable coating composition over at least a portion of the substrate;

optionally, curing the electrodeposition coating layer;

forming a first basecoating layer on the electrodeposition coating layer by depositing an aqueous curable first basecoating composition directly onto at least a portion of the electrodeposition coating layer, the first basecoating composition comprising:

(i) a first resinous binder, and (ii) a first pigment composition comprising one or more pigments dispersed in the first resinous binder;

optionally, dehydrating the first basecoating layer;

forming a second basecoating layer on the first basecoating layer by depositing an aqueous curable second basecoating composition directly onto at least a portion of the first basecoating layer, the second basecoating composition comprising:

(i) a second resinous binder which is the same or different from the first resinous binder, and (ii) a second pigment composition, which is different from the first pigment composition, comprising one or more color-enhancing and/or effect-enhancing pigments dispersed in the second resinous binder, optionally, dehydrating the second basecoating layer;

forming a top coating layer on the second basecoating layer by depositing a curable top coating composition which is substantially pigment-free directly onto at least a portion of the second basecoating layer; and curing the top coating layer, the second basecoating layer, the first basecoating layer, and, optionally, the electrodeposition coating layer simultaneously, wherein the first basecoating composition further comprises a composition comprising the second pigment composition dispersed in the second resinous binder, and wherein the second coating composition has a pigment to binder ratio ranging from 0.1 to 4.0:1.

In a further embodiment, the present invention provides a process for forming a multilayer composite coating on a substrate, the process comprising:

forming an electrodeposition coating layer on the substrate by electrodeposition of a curable electrodepositable coating composition over at least a portion of the substrate;

optionally, curing the electrodeposition coating layer;

forming a first basecoating layer on the electrodeposition coating layer by depositing an aqueous curable first basecoating composition directly onto at least a portion of the electrodeposition coating layer, the first basecoating composition comprising:

(i) a first resinous binder, and (ii) a first pigment composition comprising one or more pigments dispersed in the first resinous binder;

optionally, dehydrating the first basecoating layer;

forming a second basecoating layer on the first basecoating layer by depositing an aqueous curable second basecoating composition directly onto at least a portion of the first basecoating layer, the second basecoating composition comprising:

(i) a second resinous binder which is the same or different from the first resinous binder, and (ii) a second pigment composition, which is different from the first pigment composition, comprising one or more color-enhancing and/or effect-enhancing pigments dispersed in the second resinous binder, optionally, dehydrating the second basecoating layer;

forming a top coating layer on the second basecoating layer by depositing a curable top coating composition which is substantially pigment-free directly onto at least a portion of the second basecoating layer; and curing the top coating layer, the second basecoating layer, the first basecoating layer, and, optionally, the primer coating layer simultaneously, and wherein the first basecoating layer when cured has 5 percent or less light transmission measured at 400 nanometers at a film thickness of 15 micrometers.

Additionally, the present invention is directed to a process for forming a multilayer composite coating on a substrate, the process comprising:

forming an electrodeposition coating layer on the substrate by electrodeposition of a curable electrodepositable coating composition over at least a portion of the substrate;

optionally, curing the electrodeposition coating layer;

forming a first basecoating layer on the electrodeposition coating layer by depositing an aqueous curable first basecoating composition directly onto at least a portion of the electrodeposition coating layer, the first basecoating composition comprising:

(i) a first resinous binder, and (ii) a first pigment composition comprising one or more pigments dispersed in the first resinous binder;

optionally, dehydrating the first basecoating layer;

forming a second basecoating layer on the first basecoating layer by depositing an aqueous curable second basecoating composition directly onto at least a portion of the first basecoating layer, the second basecoating composition comprising:

(i) a second resinous binder which is the same or different from the first resinous binder, and (ii) a second pigment composition, which is different from the first pigment composition, comprising one or more color-enhancing and/or effect-enhancing pigments dispersed in the second resinous binder, optionally, dehydrating the second basecoating layer;

forming a top coating layer on the second basecoating layer by depositing a curable top coating composition which is substantially pigment-free directly onto at least a portion of the second basecoating layer; and curing the top coating layer, the second basecoating layer, the first basecoating layer, and, optionally, the electrodeposition coating layer simultaneously, wherein the second coating composition has a pigment to binder ratio ranging from 0.1 to 4.0:1, wherein both the first resinous binder and the second resinous binder comprise the same or different polyurethane polymer, wherein the first basecoating layer when cured has 5 percent or less light transmission measured at 400 nanometers at a film thickness of 15 micrometers, and wherein the first basecoating composition further comprises a composition comprising the second pigment composition dispersed in the second resinous binder, said composition being admixed with the first basecoating composition immediately prior to deposition of the first basecoating composition directly onto the electrodeposition coating layer.

In one particular embodiment, the present invention is directed to a process for forming a multilayer composite coating on a substrate, the process comprising:

forming an electrodeposition coating layer on the substrate by electrodeposition of a curable electrodepositable coating composition over at least a portion of the substrate;

optionally, curing the electrodeposition coating layer;

forming a first basecoating layer on the electrodeposition coating layer by depositing an aqueous curable first basecoating composition directly onto at least a portion of the electrodeposition coating layer, the first basecoating composition comprising:

(i) a first resinous binder, and (ii) a first pigment composition comprising one or more pigments dispersed in the first resinous binder;

optionally, dehydrating the first basecoating layer;

forming a second basecoating layer on the first basecoating layer by depositing an aqueous curable second basecoating composition directly onto at least a portion of the first basecoating layer, the second basecoating composition comprising:

(i) a second resinous binder which is the same or different from the first resinous binder, and (ii) a second pigment composition, which is different from the first pigment composition, comprising one or more color-enhancing and/or effect-enhancing pigments dispersed in the second resinous binder, optionally, dehydrating the second basecoating layer;

forming a top coating layer on the second basecoating layer by depositing a curable top coating composition which is substantially pigment-free directly onto at least a portion of the second basecoating layer;

curing the top coating layer, the second basecoating layer, the first basecoating layer, and, optionally, the electrodeposition coating layer simultaneously, wherein the first basecoating composition further comprises a composition comprising the second pigment composition dispersed in the second resinous binder, and wherein both the first resinous binder and the second resinous binder comprise the same or different polyurethane polymer, said polyurethane polymer being present in the first basecoating composition at a concentration which is equal to or less than the concentration of said polyurethane polymer present in the second basecoating composition, where concentrations are based on total resin solids present in the first and second basecoating compositions.

The present invention is further directed to a process for forming a multilayer composite coating on a substrate, the process comprising:

forming a first basecoating layer on the substrate by depositing an aqueous curable first basecoating composition over at least a portion of the substrate with no intervening primer-surfacer layer, optionally, dehydrating the first basecoating layer;

forming a second basecoating layer on the first basecoating layer by depositing an aqueous curable second basecoating composition, which is the same or different from the first basecoating composition, directly onto at least a portion of the first basecoating layer, optionally, dehydrating the second basecoating layer;

forming a top coating layer on the second basecoating layer by depositing a curable top coating composition which is substantially pigment-free directly onto at least a portion of the second basecoating layer; and curing the top coating layer, the second basecoating layer, and the first basecoating layer simultaneously.

In one embodiment, the present invention provides a method of applying a composite coating over a vehicle substrate, comprising the steps of:

(a) applying an electrodeposited coating over at least a portion of the vehicle substrate;

(b) providing a first aqueous basecoat composition comprising a first resinous binder and a first pigment composition;

(c) providing a second aqueous basecoat composition comprising a second resinous binder and a second pigment composition, with the second pigment composition being different than the first pigment composition;

(d) applying the second basecoat composition onto the interior cut-in portions of the vehicle substrate;

(e) applying the first basecoat composition onto the electrodeposited coating; and (f) applying the second basecoat composition wet-on-wet directly onto the first basecoat composition with no dehydration of the first basecoat composition to form a composite basecoat having a first basecoat layer and a second basecoat layer.

The present invention further provides an improved process for forming a multilayer composite coating on a motor vehicle substrate comprising the sequential steps of:

(1) passing a conductive motor vehicle substrate to an electrocoating station located on a coating line;

(2) electrocoating the substrate serving as a charged electrode in an electrical circuit comprising said electrode and an oppositely charged counter electrode, said electrodes being immersed in an aqueous electrodepositable composition, comprising passing electric current between said electrodes to cause deposition of the electrodepositable composition on the substrate as a substantially continuous film of electrodeposition coating;

(3) passing the coated substrate of step (2) through an electrodeposition coating thermal curing oven located on the coating line to cure the electrodepositable composition on the substrate forming an electrodeposition coating layer thereon;

(4) passing the coated substrate of step (3) to a primer-surfacer coating station located on the coating line;

(5) applying a primer-surfacer coating composition directly to at least a portion of the electrodeposition coating layer to form a primer-surfacer coating layer thereon;

(6) passing the coated substrate of step (5) through a primer-surfacer thermal curing oven located on the coating line to cure the primer-surfacer coating layer;

(7) passing the coated substrate of step (6) to a basecoating station located on the coating line;

(8) applying an aqueous basecoating composition directly onto at least a portion of the primer-surfacer coating layer to form a basecoating layer thereon;

(9) optionally, passing the coated substrate of step (8) through a flash oven located on the coating line to dehydrate but not cure the basecoating layer;

(10) passing the coating substrate of step (8), or optionally step (9), to a clearcoating station located on the coating line;

(11) applying a substantially pigment-free coating composition directly onto at least a portion of the basecoating layer to form a clearcoating layer thereon; and

(12) passing the coating substrate of step (11) through a topcoating curing station located on the coating line to cure the basecoating layer and the clearcoating layer simultaneously. The improvement comprises: passing the coated substrate of step (3) directly to a basecoating station located a coating line, sequentially applying in a wet-on-wet application, separate, multiple aqueous basecoating compositions, with optional dehydration of each of the successive basecoating compositions, directly onto at least a portion of the electrodeposition coating layer, to form a multilayer basecoating thereon, with no intervening primer-surfacer coating layer between the electrodeposition coating layer and the basecoating layer, passing the coated substrate to a clearcoating station located on the coating line, applying a substantially pigment-free coating composition directly onto at least a portion of the multilayer basecoating to form a clearcoating layer thereon, and passing the coated substrate through a topcoating curing station located in the curing line to cure the multilayer basecoating and the clearcoating layer simultaneously.

Also, the present invention is directed to a coating line, comprising:

an electrocoating zone including at least one electrodeposition bath;

a basecoat zone located downstream of and adjacent to the electrocoating zone, the basecoat zone comprising a cut-in station, a first basecoat station, and a second basecoat station; and a topcoat zone located downstream of and adjacent to the basecoat zone.

The present invention is also directed to a process for forming a multilayer composite coating on a substrate, the process comprising:

forming an electrodeposition coating layer on the substrate by electrodeposition of a curable electrodepositable coating composition over at least a portion of the substrate;

optionally, heating the coated substrate to a temperature and for a time sufficient to cure the electrodeposition coating layer;

forming a first basecoating layer on the electrodeposition coating layer by depositing an aqueous curable first basecoating composition directly onto at least a portion of the electrodeposition coating layer, optionally, dehydrating the first basecoating layer;

forming a second basecoating layer on the first basecoating layer by depositing an aqueous curable second basecoating composition, which is the same or different from the first basecoating composition, directly onto at least a portion of the first basecoating layer, optionally, dehydrating the second basecoating layer;

forming a top coating layer on the second basecoating layer by depositing a curable top coating composition which is substantially pigment-free directly onto at least a portion of the second basecoating layer; and curing the top coating layer, the second basecoating layer, the first basecoating layer, and, optionally, the electrodeposition coating layer simultaneously, wherein the first basecoating composition comprises one or more aqueous dispersions of polymeric microparticles prepared from a monomer admixture comprising one or more monomers having two or more sites of reactive ethylenic unsaturation and/or a combination of two different monomers having mutually reactive groups.

DETAILED DESCRIPTION OF THE INVENTION

Figure 1:
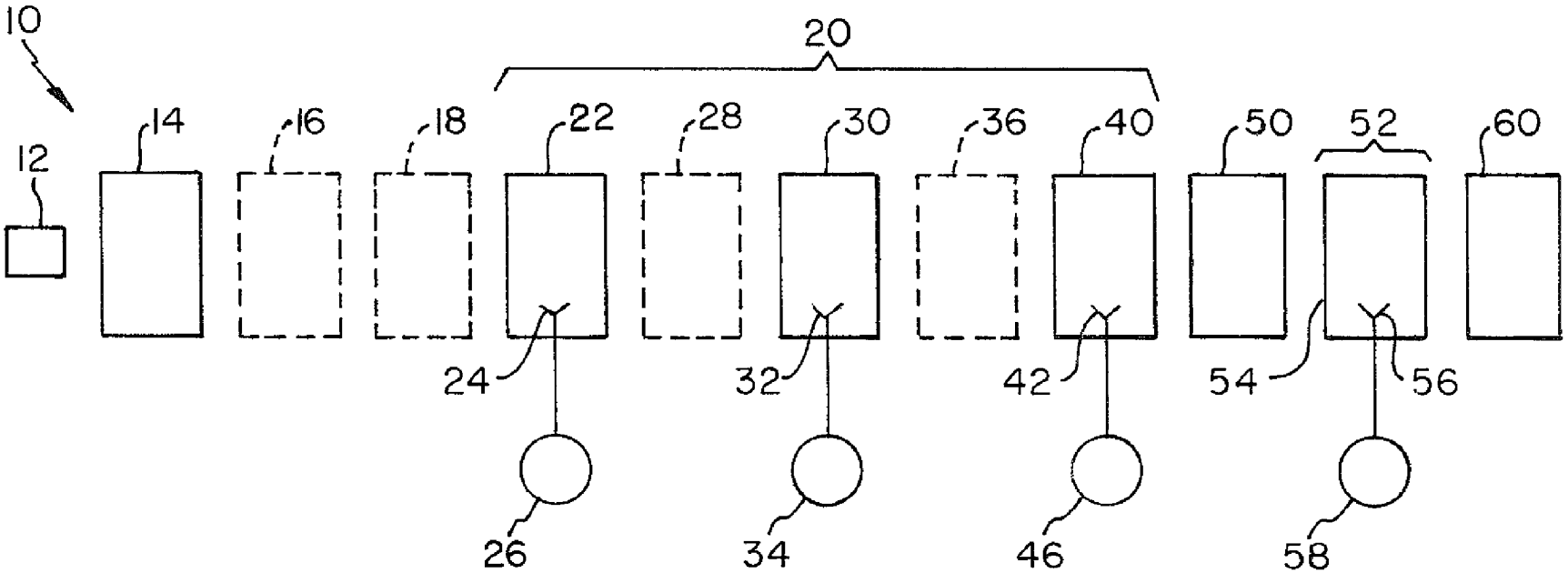
FIG. 1 is a schematic block diagram (not to scale) of a coating system incorporating features of the present invention.

As used herein, spatial or directional terms, such as "inner", "outer", "left", "right", "up", "down", "horizontal", "vertical", and the like, relate to the invention as it is shown in the drawing figure. However, it is to be understood that the invention can assume various alternative orientations and, accordingly, such terms are not to be considered as limiting. Also, as used herein, the terms "deposited over", "applied over", or "provided over" mean deposited, applied, or provided on, but not necessarily in surface contact with. For example, a material "deposited over" a substrate does not preclude the presence of one or more other materials of the same or different composition located between the deposited material and the substrate. Additionally, the terms "upstream" and "downstream" refer to the direction of movement of a substrate in the described coating process.

Other than in the operating examples, or where otherwise indicated, all numbers expressing quantities of ingredients, reaction conditions and so forth used in the specification and claims are to be understood as being modified in all instances by the term "about." Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical values, however, inherently contain certain errors necessarily resulting from the standard deviation found in their respective testing measurements.

Also, it should be understood that any numerical range recited herein is intended to include all sub-ranges subsumed therein. For example, a range of 1" to 10" is intended to include all sub-ranges between and including the recited minimum value of 1 and the recited maximum value of 10, that is, having a minimum value equal to or greater than 1 and a maximum value of equal to or less than 10.

Also, as used herein, the term "polymer" is meant to refer to oligomers and both homopolymers and copolymers. Unless stated otherwise, as used in the specification and the claims, molecular weights are number average molecular weights for polymeric materials indicated as "Mn" and obtained by gel permeation chromatography using polystyrene standards in an art-recognized manner.

Before describing in detail an exemplary practice of the invention, an exemplary coating line (coating system) incorporating features of the invention will be briefly described.

FIG. 1 schematically depicts a coating system 10 incorporating features of the invention. This system 10 is suitable for coating substrates, e.g., metal or polymeric substrates, in a batch or continuous process. In a batch process, the substrate is stationary during each treatment step whereas in a continuous process the substrate is in continuous movement along the coating line. An exemplary process of the invention will be discussed first in the context of coating a substrate in a continuous coating line.

Useful substrates that can be coated according to the method of the present invention include metallic substrates, polymeric substrates, such as thermoset materials and thermoplastic materials, and combinations thereof. The substrates can be used as components to fabricate automotive vehicles, including but not limited to automobiles, trucks and tractors. The substrates can have any shape, but in one embodiment are in the form of automotive body components such as bodies (frames), hoods, doors, fenders, bumpers and/or trim for automotive vehicles.

With reference to FIG. 1, a metal substrate 12 can be cleaned and degreased at a pretreatment zone 14. A pretreatment coating, such as CHEMFOS 700® zinc phosphate or BONAZINC® zinc-rich pretreatment (each commercially available from PPG Industries, Inc. of Pittsburgh, Pa.), can be deposited over the surface of the metal substrate 12.

Alternatively or additionally, one or more optional electrodeposition coating compositions can be electrodeposited over at least a portion of the metal substrate 12 at an optional electrodeposition zone 16. One suitable electrodeposition coating is POWER PRIME® coating commercially available from PPG Industries, Inc. of Pittsburgh, Pa. Useful electrodeposition methods and electrodeposition coating compositions include conventional anionic or cationic electrodepositable coating compositions, such as epoxy or polyurethane-based coatings. Suitable electrodepositable coatings are discussed in U.S. Pat. Nos. 4,933,056; 5,530,043; 5,760,107 and 5,820,987, which are incorporated herein by reference. The optional electrodeposition coating can be optionally dried or cured in a drying device, such as an oven 18, before further processing. Alternatively, additional coatings as described below can be applied wet-on-wet over the electrodeposition coating.

Unlike conventional coating lines, the coating line of the invention does not include a primer-surfacer zone for application, curing, and/or sanding of a primer-surfacer. By eliminating the need for a primer-surfacer, the coating equipment required for primer-surfacer application, e.g., coating booths, coating applicators, drying ovens, sanding equipment, and tacking equipment, can also be eliminated. Additionally, the elimination of the primer-surfacer also speeds up the overall coating process and reduces the floor space needed to coat the substrate 12.

A multi-layer basecoat can be applied over the substrate 12 in a multi-step method at a basecoat zone 20 comprising one or more coating stations. The basecoat zone 20 can be located downstream of and/or adjacent to the electrodeposition zone 16. As used herein, the term "adjacent to" means that there are no intervening coating stations or major processing stations located between the adjacent stations. In the embodiment shown in FIG. 1, the substrate 12 is conveyed into a cut-in station 22 having one or more conventional coating applicators 24, such as conventional bell or gun applicators. As will be appreciated by one of ordinary skill in the automotive coating art, bell applicators typically include a body portion or bell having a rotating cup. The bell is connected to a high voltage source to provide an electrostatic field between the bell and the substrate. The electrostatic field shapes the charged, atomized coating material discharged from the bell into a cone-shaped pattern, the shape of which can be varied by shaping air ejected from a shaping air ring on the bell. Non-limiting examples of suitable conventional bell applicators include Eco-Bell or Eco-M Bell applicators commercially available from Behr Systems Inc. of Auburn Hills, Mich.; Meta-Bell applicators commercially available from ABB/Ransburg Japan Limited of Tokyo, Japan; G-1 Bell applicators commercially available from ABB Flexible Automation of Auburn Hills, Mich.; or Sames PPH 605 or 607 applicators commercially available from Sames of Livonia, Mich.; or the like.

The applicators 24 are connected to and are in flow communication with a source 26 of a basecoat composition. In one embodiment, the basecoat composition in the source 26 is the "second basecoat composition" described in detail below. In another embodiment, the source 26 includes an admixture of the "first and second basecoat compositions" described below. In the cut-in station 22, the basecoat composition from the source 26 is applied over the cut-in portions of the substrate 12. As will be appreciated by one of ordinary skill in the automotive coating art, the term "cut-in portions" refers to those areas of the substrate that are not normally subjected to exposure to corrosive atmospheric conditions. Examples of cut-in portions include the interior door jams, the inside of the trunk lid, etc. An optional drying device, such as an oven 28 or flash chamber, can be located downstream of and/or adjacent to the cut-in station 22 to optionally flash, dry, or cure the coating applied over the cut-in portions before further coating.

After the cut-in station 22, the substrate 12 can be conveyed into an adjacent first basecoat station 30 having one or more conventional applicators 32, e.g., bell or gun applicators, connected to or in flow communication with a source 34 of a first basecoat material or composition as described in more detail below. The first basecoat composition can be applied, e.g., sprayed, over the substrate 12 by one or more applicators 32 at the first basecoat station 30 in one or more spray passes to form a first basecoat layer over the substrate 12. As will be described in more detail below, the first basecoat composition includes a first resinous binder and a first pigment composition comprising one or more pigments dispersed in the first resinous binder.

An optional drying device, such as an oven 36 or flash chamber, can be located downstream of and/or adjacent to the first basecoat station 30 to optionally flash, dry, or cure the coating applied at the first basecoat station 30 (and optionally the coating applied over the cut-in portions) before further coating. The temperature and humidity in the drying device can be controlled to control evaporation from the deposited first basecoat composition to form a first basecoat layer with sufficient moisture content or "wetness" such that a substantially smooth, substantially level film of substantially uniform thickness is obtained without sagging. In one embodiment, there is no dehydration of the applied first basecoat composition before application of the second basecoat composition described below.

A second basecoat station 40 can be located downstream of and/or adjacent to the first basecoat station 30 and can have one or more conventional applicators 42, e.g., bell or gun applicators, connected to and in flow communication with a source 46 of a second basecoat composition as described in more detail below. The second basecoat composition can be applied, e.g., sprayed, over the first basecoat composition by one or more applicators 42 at the second basecoat station 40 in one or more spray passes to form a second basecoat layer over the first basecoat layer. In one embodiment, the second basecoat composition is applied "wet-on-wet" onto the first basecoat composition, i.e., there is no dehydration of the applied first basecoat composition before application of the second basecoat composition. Thus, a multilayer composite basecoat can be formed by one or more second basecoat layers applied over one or more first basecoat layers. As used herein, the terms "layer" or "layers" refer to general coating regions or areas which can be applied by one or more spray passes but do not necessarily mean that there is a distinct or abrupt interface between adjacent layers, i.e., there can be some migration of components between the first and second basecoat layers. As described in more detail below, the second basecoat composition includes a second resinous binder that can be the same or different than the first resinous binder. The second basecoat composition also includes a second pigment composition that can be the same as or different than the first pigment composition.

A conventional drying device, such as an oven 50, can be located downstream of and/or adjacent to the second coating station 40 where the coating(s) applied at the cut-in station 22, and/or the first basecoat station 30, and/or the second basecoat station 40 can be dried or cured. For waterborne basecoats, "dry" means the almost complete absence of water from the applied compositions. Drying the basecoat enables application of a subsequent protective topcoat or clearcoat, as described below, such that the quality of the clearcoat will not be adversely affected by further drying of the basecoat. If too much water is present in the basecoat, the subsequently applied clearcoat can crack, bubble or "pop" during drying of the clearcoat as water vapor from the basecoat attempts to pass through the clearcoat. The oven 50 can be a conventional drying oven or drying apparatus, such as an infrared radiation oven commercially available from BGK-ITW Automotive Group of Minneapolis, Minn.

After the basecoat compositions on the substrate 12 have been optionally dried (and cured and/or cooled, if desired) in the oven 50, one or more conventional clearcoats or topcoats can be applied over the basecoat at a clearcoat zone 52 comprising one or more clearcoat stations 54. Each clearcoat station includes one or more conventional applicators 56 (e.g., bell applicators) connected to and in flow communication with a source 58 of clearcoat material.

In the embodiment shown in FIG. 1, a drying station 60 is located downstream of and/or adjacent to the clearcoat station 54 to dry and/or cure the applied clearcoat material and/or optionally one or more of the previously applied basecoat compositions. As used herein, "cure" means that any crosslinkable components of the material are substantially crosslinked as discussed in more detail below. This curing step can be carried out by any conventional drying technique, such as hot air convection drying using a hot air convection oven (such as an automotive radiant wall/convection oven which is commercially available from Durr, Haden or Thermal Engineering Corporation) or, if desired, infrared heating, such that any crosslinkable components of the liquid clearcoat material are crosslinked to such a degree that the automobile industry accepts the coating method as sufficiently complete to transport the coated automobile body without damage to the clearcoat. Generally, the liquid clearcoat material is heated to a temperature of 120° C. to 150° C. for a period of 20 to 40 minutes to cure the liquid clearcoat.

Alternatively, if one or more of the basecoat compositions were not cured prior to applying the liquid clearcoat material, both the basecoat compositions and the liquid clearcoat material can be cured together by applying hot air convection and/or infrared heating using conventional apparatus to cure both the basecoat compositions and the liquid clearcoat material.

Figure 2:
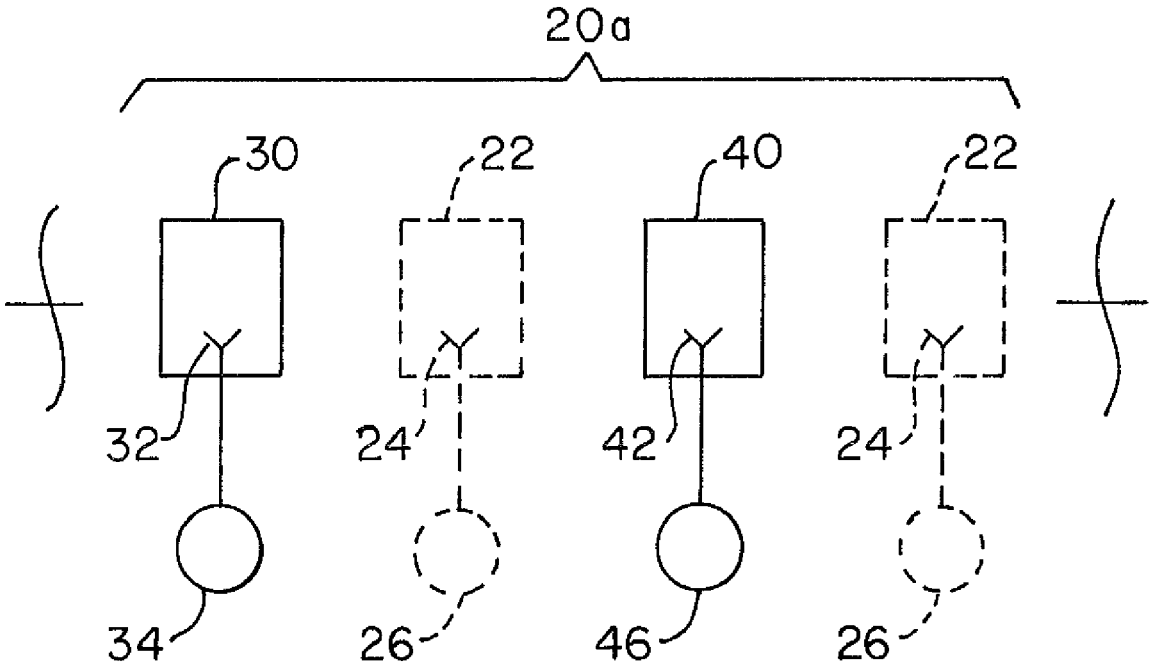
FIG. 2 is a schematic block diagram (not to scale) of a basecoat zone of another embodiment of a coating system incorporating features of the present invention.

FIG. 2 illustrates an alternative basecoat zone 20*a* that can be utilized in the practice of the invention. As shown by dashed lines, in this embodiment the cut-in station 22 can be optionally located between the first and second basecoat stations 30, 40 (i.e., downstream of the first basecoat station 30). Alternatively, the cut-in station 22 can be located downstream of the second basecoat station 40. Optional drying devices (not shown) can also be optionally located downstream of one or more of the first basecoat station 30, the cut-in station 22, and/or the second basecoat station 40, if desired.

Having described exemplary coating systems of the invention, exemplary coating processes of the invention will now be described.

As described above, in one embodiment, the present invention is directed to a process for forming a multilayer composite coating on a substrate. The process comprises: forming an electrodeposition coating layer on the substrate by electrodeposition of a curable electrodepositable coating composition over at least a portion of the substrate; optionally, heating the coated substrate to a temperature and for a time sufficient to cure the electrodeposition coating layer; forming a basecoating layer over the electrodeposition coating layer by depositing an aqueous curable basecoating composition directly onto at least a portion of the electrodeposition coating layer; optionally, dehydrating the basecoating layer; forming a top coating layer over the basecoating layer by depositing a curable top coating composition which is substantially pigment-free directly onto at least a portion of the basecoating layer; and curing the top coating layer, the basecoating layer, and, optionally, the electrodeposition coating layer simultaneously.

The electrodeposition coating composition can be applied to either bare metal or pretreated metal substrates. By "bare metal" is meant a virgin metal substrate that has not been treated with a pretreatment composition such as conventional phosphating solutions, heavy metal rinses and the like. Additionally, for purposes of the present invention, 'bare metal' substrates can include a cut edge of a substrate that is otherwise treated and/or coated over the non-edge surfaces of the substrate.

Before any treatment or application of any coating composition, the substrate optionally may be formed into an object of manufacture. A combination of more than one metal substrate can be assembled together to form such an object of manufacture.

The "substrate" upon which the electrodeposition coating composition is deposited can comprise any electroconductive substrates including those described in detail below, to which one or more pretreatment and/or primer coatings have been previously applied. For example, the "substrate" can comprise a metallic substrate and a weldable primer coating over at least a portion of the substrate surface. The electrodepositable coating composition described above is then electrodeposited and cured over at least a portion thereof. One or more top coating compositions as described in detail below are subsequently applied over at least a portion of the cured electrodeposited coating.

For example, the substrate can comprise any of the foregoing electroconductive substrates and a pre-treatment composition applied over at least a portion of the substrate, the pretreatment composition comprising a solution that contains one or more Group IIIB or IVB element-containing compounds, or mixtures thereof, solubilized or dispersed in a carrier medium, typically an aqueous medium. The Group IIIB and IVB elements are defined by the CAS Periodic Table of the Elements as shown, for example, in the Handbook of Chemistry and Physics, (60th Ed. 1980). Transition metal compounds and rare earth metal compounds typically are compounds of zirconium, titanium, hafnium, yttrium and cerium and mixtures thereof. Typical zirconium compounds may be selected from hexafluorozirconic acid, alkali metal and ammonium salts thereof, ammonium zirconium carbonate, zirconyl nitrate, zirconium carboxylates and zirconium hydroxy carboxylates such as hydrofluorozirconic acid, zirconium acetate, zirconium oxalate, ammonium zirconium glycolate, ammonium zirconium lactate, ammonium zirconium citrate, and mixtures thereof.

The pretreatment composition carrier also can contain a film-forming resin, for example, the reaction products of one or more alkanolamines and an epoxy-functional material containing at least two epoxy groups, such as those disclosed in U.S. Pat. No. 5,653,823. Other suitable resins include water soluble and water dispersible polyacrylic acids such as those as disclosed in U.S. Pat. Nos. 3,912,548 and 5,328,525; phenol-formaldehyde resins as described in U.S. Pat. No. 5,662,746, incorporated herein by reference; water soluble polyamides such as those disclosed in WO 95/33869; copolymers of maleic or acrylic acid with allyl ether as described in Canadian patent application 2,087,352; and water soluble and dispersible resins including epoxy resins, aminoplasts, phenol-formaldehyde resins, tannins, and polyvinyl phenols as discussed in U.S. Pat. No. 5,449,415.

Further, non-ferrous or ferrous metallic substrates can be pretreated with a non-insulating layer of organophosphates or organophosphonates such as those described in U.S. Pat. Nos. 5,294,265 and 5,306,526. Such organophosphate or organophosphonate pretreatments are available commercially from PPG Industries, Inc. under the trade name NUPAL®. Application to the substrate of a non-conductive coating, such as NUPAL, typically is followed by the step of rinsing the substrate with deionized water prior to the coalescing of the coating. This ensures that the layer of the non-conductive coating is sufficiently thin to be non-insulating, i.e., sufficiently thin such that the non-conductive coating does not interfere with electroconductivity of the substrate, allowing subsequent electrodeposition of a electrodepositable coating composition. The pretreatment coating composition can further comprise surfactants that function as aids to improve wetting of the substrate. Generally, the surfactant materials are present in an amount of less than about 2 weight percent on a basis of total weight of the pretreatment coating composition. Other optional materials in the carrier medium include defoamers and substrate wetting agents.

Due to environmental concerns, the pretreatment coating composition can be free of chromium-containing materials, i.e., the composition contains less than about 2 weight percent of chromium-containing materials (expressed as $CrO_3$), typically less than about 0.05 weight percent of chromium-containing materials.

In the pre-treatment process, before depositing the pretreatment composition upon the surface of the metal substrate, it is usual practice to remove foreign matter from the metal surface by thoroughly cleaning and degreasing the surface. The surface of the metal substrate can be cleaned by physical or chemical means, such as by mechanically abrading the surface or cleaning/degreasing with commercially available alkaline or acidic cleaning agents which are well know to those skilled in the art, such as sodium metasilicate and sodium hydroxide. A non-limiting example of a suitable cleaning agent is CHEMKLEEN® 163, an alkaline-based cleaner commercially available from PPG Pretreatment and Specialty Products of Troy, Mich. Acidic cleaners also can be used. Following the cleaning step, the metal substrate is usually rinsed with water in order to remove any residue. The metal substrate can be air-dried using an air knife, by flashing off the water by brief exposure of the substrate to a high temperature or by passing the substrate between squeegee rolls. The pretreatment coating composition can be deposited upon at least a portion of the outer surface of the metal substrate. Preferably, the entire outer surface of the metal substrate is treated with the pretreatment composition. The thickness of the pretreatment film can vary, but is generally less than about 1 micrometer, preferably ranges from about 1 to about 500 nanometers, and more preferably ranges from about 10 to about 300 nanometers.

The pretreatment coating composition is applied to the surface of the substrate by any conventional application technique, such as by spraying, immersion or roll coating in a batch or continuous process. The temperature of the pretreatment coating composition at application is typically about 10° C. to about 85° C., and preferably about 15° C. to about 60° C. The pH of the pretreatment coating composition at application generally ranges from 2.0 to 5.5, and typically from 3.5 to 5.5. The pH of the medium may be adjusted using mineral acids such as hydrofluoric acid, fluoroboric acid, phosphoric acid, and the like, including mixtures thereof; organic acids such as lactic acid, acetic acid, citric acid, sulfamic acid, or mixtures thereof; and water soluble or water dispersible bases such as sodium hydroxide, ammonium hydroxide, ammonia, or amines such as triethylamine, methylethyl amine, or mixtures thereof.

Continuous processes typically are used in the coil coating industry and also for mill application. The pretreatment coating composition can be applied by any of these conventional processes. For example, in the coil industry, the substrate typically is cleaned and rinsed and then contacted with the pretreatment coating composition by roll coating with a chemical coater. The treated strip is then dried by heating, painted and baked by conventional coil coating processes.

Mill application of the pretreatment composition can be by immersion, spray or roll coating applied to the freshly manufactured metal strip. Excess pretreatment composition is typically removed by wringer rolls. After the pretreatment composition has been applied to the metal surface, the metal can be rinsed with deionized water and dried at room temperature or at elevated temperatures to remove excess moisture from the treated substrate surface and cure any curable coating components to form the pretreatment coating. Alternatively, the treated substrate can be heated to a temperature ranging from 65° C. to 125° C. for 2 to 30 seconds to produce a coated substrate having a dried residue of the pretreatment coating composition thereon. If the substrate is already heated from the hot melt production process, no post application heating of the treated substrate is required to facilitate drying. The temperature and time for drying the coating will depend upon such variables as the percentage of solids in the coating, components of the coating composition and type of substrate.

The film coverage of the residue of the pretreatment composition generally ranges from 1 to 10,000 milligrams per square meter ($mg/m^2$), and usually from 10 to 400 $mg/m^2$.

A layer of a weldable primer also can be applied over the substrate, whether or not the substrate has been pretreated. Non-limiting examples of suitable weldable primers include those described in U.S. Pat. Nos. 5,580,371; 5,652,024; 5,584,946; and 3,792,850. The weldable primer can comprise a reactive functional group-containing film-forming polymer, for example a polyepoxide polymer or an acrylic polymer having epoxy functional groups; and a crosslinking agent adapted to react with the functional groups of the film-forming polymer. The weldable primer composition further comprises one or more conductive pigments such as carbon black, present in an amount sufficient to render the cured primer weldable. A typical weldable primer is BONAZINC®, a zinc-rich mill applied organic film-forming composition, which is commercially available from PPG Industries, Inc., Pittsburgh, Pa. BONAZINC can be applied to a thickness of at least 1 micrometer and typically to a thickness of 3 to 4 micrometers. Other weldable primers, such as iron phosphide-rich primers, are commercially available.

The optional electrodeposition step of any of the processes of the present invention can include immersing the electroconductive substrate into an electrodeposition bath of an aqueous electrodepositable composition, the substrate serving as a cathode in an electrical circuit comprising the cathode and an anode. Sufficient electrical current is applied between the electrodes to deposit a substantially continuous, adherent film of the electrodepositable coating composition onto or over at least a portion of the surface of the electroconductive substrate. Also, it should be understood that as used herein, an electrodepositable composition or coating formed "over" at least a portion of a "substrate" refers to a composition formed directly on at least a portion of the substrate surface, as well as a composition or coating formed over any coating or pretreatment material which was previously applied to at least a portion of the substrate. Electrodeposition is usually carried out at a constant voltage in the range of from 1 volt to several thousand volts, typically between 50 and 500 volts. Current density is usually between 1.0 ampere and 15 amperes per square foot (10.8 to 161.5 amperes per square meter) and tends to decrease quickly during the electrodeposition process, indicating formation of a continuous, self-insulating film.

Once the electrodepositable coating composition (described in detail below) is applied as described above, thereby forming an electrodeposition coating layer over the substrate, the electrodeposition coating layer, optionally, is heated to a temperature and for a time sufficient to cure the electrodeposition coating layer. The coated substrate can be heated to a temperature ranging from 250° to 450° F. (121.1° to 232.2° C.), often from 250° to 400° F. (121.1° to 204.4° C.), and typically from 300° to 360° (148.9° to 180° C.). The curing time can be dependent upon the curing temperature as well as other variables, for example, film thickness of the electrodeposited coating, level and type of catalyst present in the composition and the like. For purposes of the present invention, all that is necessary is that the time be sufficient to effect cure of the electrodeposited coating on the substrate. For example, the curing time can range from 10 minutes to 60 minutes, and typically from 10 to 30 minutes. The thickness of the resultant cured electrodeposited coating usually ranges from 15 to 50 microns.

As used herein, the term "cure" as used in connection with a composition, e.g., "a cured composition," shall mean that any crosslinkable components of the composition are at least partially crosslinked. In certain embodiments of the present invention, the crosslink density of the crosslinkable components, i.e., the degree of crosslinking, ranges from 5% to 100% of complete crosslinking. In other embodiments, the crosslink density ranges from 35% to 85% of full crosslinking. In other embodiments, the crosslink density ranges from 50% to 85% of full crosslinking. One skilled in the art will understand that the presence and degree of crosslinking, i.e., the crosslink density, can be determined by a variety of methods, such as dynamic mechanical thermal analysis (DMTA) using a TA Instruments DMA 2980 DMTA analyzer conducted under nitrogen. This method determines the glass transition temperature and crosslink density of free films of coatings or polymers. These physical properties of a cured material are related to the structure of the crosslinked network.

The electrodepositable coating composition employed in the processes of the present invention can be any of the anionic or cationic electrodepositable coating compositions well known in the art. As aforementioned, electrodepostable cationic compositions are typically used in the electrocoating of metallic motor vehicle or automotive substrates.

Electrodepositable coating compositions usually comprise a resinous phase dispersed in an aqueous medium, the resinous phase comprising (a) an ungelled, active hydrogen group-containing ionic resin, and (b) a curing agent having functional groups reactive with the active hydrogen groups of (a). Such electrodepostable coating compositions typically are in the form of an electrodeposition bath.

By "ungelled" is meant the resins are substantially free of crosslinking and have an intrinsic viscosity when dissolved in a suitable solvent, as determined, for example, in accordance with ASTM-D1795 or ASTM-D4243. The intrinsic viscosity of the reaction product is an indication of its molecular weight. A gelled reaction product, on the other hand, since it is of essentially infinitely high molecular weight, will have an intrinsic viscosity too high to measure. As used herein, a reaction product that is "substantially free of crosslinking" refers to a reaction product that has a weight average molecular weight (Mw), as determined by gel permeation chromatography, of less than 1,000,000.

The term "active hydrogen" refers to those groups which are reactive with isocyanates as determined by the Zerewitnoff test as is described in the JOURNAL OF THE AMERICAN CHEMICAL SOCIETY, Vol. 49, page 3181 (1927). For example, the active hydrogens can be derived from hydroxyl groups, primary amine groups and/or secondary amine groups.

Examples of film-forming resins suitable for use in anionic electrodeposition bath compositions are base-solubilized, carboxylic acid containing polymers such as the reaction product or adduct of a drying oil or semi-drying fatty acid ester with a dicarboxylic acid or anhydride; and the reaction product of a fatty acid ester, unsaturated acid or anhydride and any additional unsaturated modifying materials which are further reacted with polyol. Also suitable are the at least partially neutralized interpolymers of hydroxy-alkyl esters of unsaturated carboxylic acids, unsaturated carboxylic acid and at least one other ethylenically unsaturated monomer. Still another suitable electrodepositable resin comprises an alkyd-aminoplast vehicle, i.e., a vehicle containing an alkyd resin and an amine-aldehyde resin. Yet another anionic electrodepositable resin composition comprises mixed esters of a resinous polyol. These compositions are described in detail in U.S. Pat. No. 3,749,657 at col. 9, lines 1 to 75 and col. 10, lines 1 to 13, all of which are herein incorporated by reference. Other acid functional polymers can also be used such as phosphatized polyepoxide or phosphatized acrylic polymers as are well known to those skilled in the art.

Cationic polymers suitable for use in the electrodepositable coating compositions can include any of a number of cationic polymers well known in the art so long as the polymers are "water dispersible," i.e., adapted to be solubilized, dispersed or emulsified in water. Such polymers comprise cationic functional groups to impart a positive charge.

Suitable examples of cationic film-forming resins include amine salt group-containing resins such as the acid-solubilized reaction products of polyepoxides and primary or secondary amines such as those described in U.S. Pat. Nos. 3,663,389; 3,984,299; 3,947,338; and 3,947,339. Usually, these amine salt group-containing resins are used in combination with a blocked isocyanate curing agent. The isocyanate can be fully blocked as described in the aforementioned U.S. Pat. No. 3,984,299 or the isocyanate can be partially blocked and reacted with the resin backbone such as described in U.S. Pat. No. 3,947,338. Also, one-component compositions as described in U.S. Pat. No. 4,134,866 and DE-OS No. 2,707,405 can be used as the film-forming resin. Besides the epoxy-amine reaction products, film-forming resins can also be selected from cationic acrylic resins such as those described in U.S. Pat. Nos. 3,455,806 and 3,928,157.

Besides amine salt group-containing resins, quaternary ammonium salt group-containing resins can also be employed. Examples of these resins are those which are formed from reacting an organic polyepoxide with a tertiary amine salt. Such resins are described in U.S. Pat. Nos. 3,962,165; 3,975,346; and 4,001,101. Examples of other cationic resins are ternary sulfonium salt group-containing resins and quaternary phosphonium salt-group containing resins such as those described in U.S. Pat. Nos. 3,793,278 and 3,984,922, respectively. Also, film-forming resins which cure via trans-esterification such as described in European Application No. 12463 can be used. Further, cationic compositions prepared from Mannich bases such as described in U.S. Pat. No. 4,134,932 can be used.

Most often, the resin (a) is a positively charged resin which contains primary and/or secondary amine groups. Such resins are described in U.S. Pat. Nos. 3,663,389; 3,947,339; and 4,116,900. In U.S. Pat. No. 3,947,339, a polyketimine derivative of a polyamine such as diethylenetriamine or triethylenetetraamine is reacted with a polyepoxide. When the reaction product is neutralized with acid and dispersed in water, free primary amine groups are generated. Also, equivalent products are formed when polyepoxide is reacted with excess polyamines such as diethylenetriamine and triethylenetetraamine and the excess polyamine vacuum stripped from the reaction mixture. Such products are described in U.S. Pat. Nos. 3,663,389 and 4,116,900.

The active hydrogen-containing, ionic electrodepositable resin described above can be present in the electrodeposition baths used in the processes of the present invention in amounts ranging from 1 to 60 percent by weight, often from 5 to 25 based on total weight of the electrodeposition bath.

The resinous phase of the electrodeposition baths suitable for use in the processes of the present invention further comprises (b) a curing agent adapted to react with the active hydrogen groups of the ionic electrodepositable resin (a) described immediately above. Both blocked organic polyisocyanate and aminoplast curing agents are suitable for use in the present invention, although blocked isocyanates typically are used for cathodic electrodeposition.

Aminoplast resins, typically used as the curing agent for anionic electrodeposition, are the condensation products of amines or amides with aldehydes. Examples of suitable amine or amides are melamine, benzoguanamine, urea and similar compounds. Generally, the aldehyde employed is formaldehyde, although products can be made from other aldehydes such as acetaldehyde and furfural. The condensation products contain methylol groups or similar alkylol groups depending on the particular aldehyde employed. Preferably, these methylol groups are etherified by reaction with an alcohol. Various alcohols employed include monohydric alcohols containing from 1 to 4 carbon atoms such as methanol, ethanol, isopropanol, and n-butanol, with methanol being preferred. Aminoplast resins are commercially available from Cytec under the trademark CYMEL and from Solutia under the trademark RESIMENE.

The aminoplast curing agents typically are utilized in conjunction with the active hydrogen containing anionic electrodepositable resin in amounts ranging from about 5 percent to about 60 percent by weight, preferably from about 20 percent to about 40 percent by weight, the percentages based on the total weight of the resin solids in the electrodeposition bath.

Typically, curing agents for use in cathodic electrodeposition include blocked organic polyisocyanates. The polyisocyanates can be fully blocked as described in U.S. Pat. No. 3,984,299 column 1 lines 1 to 68, column 2 and column 3 lines 1 to 15, or partially blocked and reacted with the polymer backbone as described in U.S. Pat. No. 3,947,338 column 2 lines 65 to 68, column 3 and column 4 lines 1 to 30, which are incorporated by reference herein. By "blocked" is meant that the isocyanate groups have been reacted with a compound so that the resultant blocked isocyanate group is stable to active hydrogens at ambient temperature but reactive with active hydrogens in the film forming polymer at elevated temperatures usually between 90° C. and 200° C.

Suitable polyisocyanates include aromatic and aliphatic polyisocyanates, including cycloaliphatic polyisocyanates and representative examples include diphenylmethane-4,4'-diisocyanate (MDI), 2,4- or 2,6-toluene diisocyanate (TDI), including mixtures thereof, p-phenylene diisocyanate, tetramethylene and hexamethylene diisocyanates, dicyclohexylmethane-4,4'-diisocyanate, isophorone diisocyanate, mixtures of phenylmethane-4,4'-diisocyanate and polymethylene polyphenylisocyanate. Higher polyisocyanates such as triisocyanates can be used, for example, triphenyl methane-4,4',4"-triisocyanate. Isocyanate prepolymers prepared in conjunction with polyols such as neopentyl glycol and trimethylolpropane and with polymeric polyols such as polycaprolactone diols and triols (NCO/OH equivalent ratio greater than 1) can also be used.

The polyisocyanate curing agents typically can be utilized in conjunction with the active hydrogen containing cationic electrodepositable resin in amounts ranging from 5 percent to 60 percent by weight, and typically from 20 percent to 50 percent by weight, the percentages based on the total weight of the resin solids of the electrodeposition bath.

The aqueous electrodepositable coating compositions are in the form of an aqueous dispersion. The term "dispersion" is believed to be a two-phase transparent, translucent or opaque resinous system in which the resin is in the dispersed phase and the water is in the continuous phase. The average particle size of the resinous phase is generally less than 1.0 and usually less than 0.5 microns, preferably less than 0.15 micron.

The concentration of the resinous phase in the aqueous medium is at least 1 and usually from 2 to 60 percent by weight based on total weight of the aqueous dispersion. When the compositions of the present invention are in the form of resin concentrates, they generally have a resin solids content ranging from 20 to 60 percent by weight based on weight of the aqueous dispersion.

In one particular embodiment of the present invention, the electrodepositable coating composition is a photodegradation-resistant composition comprising a resinous phase comprising: (1) one or more ungelled, active hydrogen-containing, cationic amine salt group-containing resins which are electrodepositable on a cathode, and (2) one or more at least partially blocked aliphatic polyisocyanate curing agents. The amine salt groups of the cationic resin (1) are derived from pendant and/or terminal amine groups having the following structures (I) or (II):

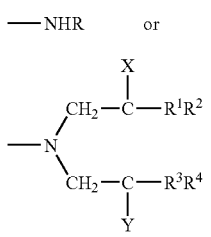

(I)

(II)

wherein R represents H or $C_1$ to $C_{18}$ alkyl; $R^1$, $R^2$, $R^3$, and $R^4$ are the same or different, and each independently represents H or $C_1$ to $C_4$ alkyl; and X and Y can be the same or different, and each independently represents a hydroxyl group or an amino group.

By "terminal and/or pendant" is meant that primary and/or secondary amino groups are present as a substituent which is pendant from or in the terminal position of the polymeric backbone, or, alternatively, is an end-group substituent of a group which is pendant and/or terminal from the polymer backbone. In other words, the amino groups from which the cationic amine salt groups are derived are not within the polymeric backbone.

By "alkyl" is meant alkyl and aralkyl, cyclic or acyclic, linear or branched monovalent hydrocarbon groups. The alkyl groups can be unsubstituted or substituted with one or more heteroaoms, for example, non-carbon, non-hydrogen atoms such as one or more oxygen, nitrogen or sulfur atoms.

The pendant and/or terminal amino groups represented by structures (I) and (II) above can be derived from a compound selected from the group consisting of ammonia, methylamine, diethanolamine, diisopropanolamine, N-hydroxyethyl ethylenediamine, diethylenetriamine, and mixtures thereof. One or more of these compounds is reacted with one or more of the above described polymers, for example, a polyepoxide polymer, where the epoxy groups are ring-opened via reaction with a polyamine, thereby providing terminal amino groups and secondary hydroxyl groups, or an acrylic polymer having epoxy functional groups derived from epoxy-functional, ethylenically unsaturated monomers, such as glycidyl methacrylate.

In one particular embodiment of the invention, the cationic salt group-containing polymer contains amine salt groups which are derived from one or more pendant and/or terminal amino groups having the structure (II) above, such that when the electrodepositable coating composition is electrodeposited and cured, at least two electron-withdrawing groups (as described in detail below) are bonded in the beta-position relative to substantially all of the nitrogen atoms present in the cured electrodeposited coating. In a further embodiment of the invention, when the electrodepositable coating composition is electrodeposited and cured, three electron-withdrawing groups are bonded in the beta-position relative to substantially all of the nitrogen atoms present in the cured electrodeposited coating. By "substantially all" of the nitrogen atoms present in the cured electrodeposited coating is meant at least 65 percent, and typically 90 percent, of all nitrogen atoms present in the cured electrodeposited coating which are derived from the amine used to form the cationic amine salt groups.

As discussed below, the electron-withdrawing groups to which reference is made herein are formed by the reaction of a polyisocyanate curing agent with the pendant and/or terminal hydroxyl and/or amino groups represented by X and Y in structure (II) which are bonded in the beta-position relative to the nitrogen atom depicted in this structure. The amount of free or unbound amine nitrogen present in a cured free film of the electrodepositable composition can be determined as follows. The cured free coating film can be cryogenically milled and dissolved with acetic acid then titrated potentiometrically with acetous perchloric acid to determine the total base content of the sample. The primary amine content of the sample can be determined by reaction of the primary amine with salicylaldehyde to form an untitratable azomethine. Any unreacted secondary and tertiary amine then can be determined by potentiometric titration with perchloric acid. The difference between the total basicity and this titration represents the primary amine. The tertiary amine content of the sample can be determined by potentiometric titration with perchloric acid after reaction of the primary and secondary amine with acetic anhydride to form the corresponding amides.

In one embodiment of the present invention, the terminal amino groups have the structure (II) where both X and Y comprise primary amino groups, e.g., the amino group is derived from diethylenetriamine. It should be understood that in this instance, prior to reaction with the polymer, the primary amino groups can be blocked, for example, by reaction with a ketone such as methyl ethyl ketone, to form the diketimine. Such ketimines are those described in U.S. Pat. No. 4,104,147, column 6, line 23 to column 7, line 23. The ketimine groups can decompose upon dispersing the amine-epoxy reaction product in water, thereby providing free primary amine groups as curing reaction sites.

Minor amounts (e.g., an amount which would represent less than or equal to 5 percent of total amine nitrogen present in the composition) of amines such as mono, di, and trialkylamines and mixed aryl-alkyl amines which do not contain hydroxyl groups, or amines substituted with groups other than hydroxyl provided that the inclusion of such amines does not negatively affect the photodegradation resistance of the cured electrodeposited coating. Specific examples include monoethanolamine, N-methylethanolamine, ethylamine, methylethylamine, triethylamine, N-benzyldimethylamine, dicocoamine and N,N-dimethylcyclohexylamine.

The reaction of the above-described amines with epoxide groups on the polymer takes place upon mixing of the amine and polymer. The amine may be added to the polymer or vice versa. The reaction can be conducted neat or in the presence of a suitable solvent such as methyl isobutyl ketone, xylene, or 1-methoxy-2-propanol. The reaction is generally exothermic and cooling may be desired. However, heating to a moderate temperature of about 50° C. to 150° C. may be done to hasten the reaction.

The active hydrogen-containing, cationic salt group-containing polymer used in the electrodepositable composition is prepared from components selected so as to maximize the photodegradation resistance of the polymer and the resulting cure electrodeposited composition. Though not intending to be bound by any theory, it is believed that photodegradation resistance (i.e., resistance to visible and ultraviolet light degradation) of the cured electrodeposited coating can be correlated with the location and nature of nitrogen-containing cationic groups used for dispersion of the active hydrogen-containing, cationic amine salt group-containing resin.

For purposes of the present invention, the amines from which the pendant and/or terminal amino groups are derived comprise primary and/or secondary amine groups such that the active hydrogens of said amines will be consumed by reaction with the at least partially blocked aliphatic polyisocyanate curing agent to form urea groups or linkages during the curing reaction. The urea groups formed during the curing reaction appear to have no significant negative influence on photodegradation resistance of the cured electrodeposited coating.

In one embodiment of the present invention, a polyepoxide polymer can be "defunctionalized" with an excess of ammonia, yielding a polymer comprising one or more of the following structural units (III). Cationic salt groups subsequently can be formed by admixing such a polymer with a suitable solubilizing acid to promote dispersion in watr.

(III)

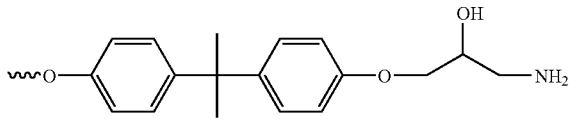

In an alternative embodiment of the present invention, the cationic polymer (1) can comprise a polyepoxide polymer having pendant and/or terminal amino groups comprising primary amine groups from which cationic amine salts can be formed. Such a polymer can be prepared, for example, by reacting diethylene triamine bis-ketamine with an epoxy group containing polymer, followed by hydrolysis to decompose the ketimine. Such a polymer can comprise one or more of the following structural units (IV):

(IV)

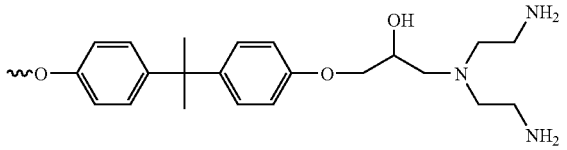

It was surprising to find that, despite the presence of the tertiary nitrogen in this structural unit, electrodeposited compositions comprising such polymers exhibit improved photodegradation resistance. Without intending to be bound by theory, it is believed that this is due to the formation during the cure reaction with the polyisocyanate curing agent of two strong electron-withdrawing groups (in this case, urea groups) bonded in the beta-position relative to the tertiary nitrogen.

Likewise, it was found that polymers comprising other structural units having isocyanate-reactive groups in the beta-position relative to the nitrogen atom also can exhibit similar photodegradation resistance. Such polymers can comprise, for example, the following structural units (V) and (VI):

(V)

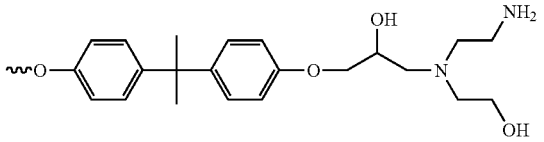

or (VI)

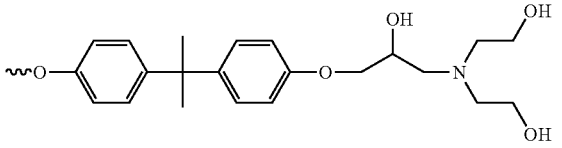

Upon reaction of polymers having one or more of the structural units (VI) with the polyisocyanate curing agent, electron-withdrawing urethane groups are formed at the beta-position relative to the tertiary nitrogen atoms which are derived from the pendant and/or terminal amino groups. Likewise, upon reaction of polymers having one or more of the structural units (V) with the polyisocyanate curing agent, electron-withdrawing urethane and urea groups are formed at the beta-position relative to the tertiary nitrogen atoms derived from the pendant and/or terminal amino groups.

As used herein, by "electron-withdrawing group" is meant a group (e.g., a urethane or urea group) that tends to draw electrons or electronegative charge from the amine nitrogen atom, thereby rendering the amine nitrogen less basic. Such electron-withdrawing groups can be derived from the reaction of the polyisocyanate curing agent with the hydroxyl and/or amino groups, represented by X and Y in structure (II) above, which are pendant and/or terminal from the resin. Moreover, it should be understood that for purposes of the present invention, the urethane groups derived from the reaction of the polyisocyanate curing agent and the hydroxyl groups along the polymer backbone, and/or the secondary hydroxyl groups which are formed upon the ring opening of an epoxy group, are not intended to be within the meaning of the term "electron-withdrawing group(s)".

It has been found that polymers comprising primarily structural units such as structural units (VII) and/or (VIII) below, where R represents an unsubstituted alkyl group, exhibit significantly poorer photodegradation resistance as compared to those polymers discussed immediately above. Without intending to be bound by theory, it is believed that the poorer photodegradation resistance of such polymers comprising primarily structural units (VII) and/or (VIII) can be attributed to the fact that the basic nitrogens are present in the backbone of the polymer (and are not pendant and/or terminal with respect to the polymer backbone) and/or do not react with the polyisocyanate curing agent to generate two electron-withdrawing groups in the beta-position relative to the basic amine group.

(VII)

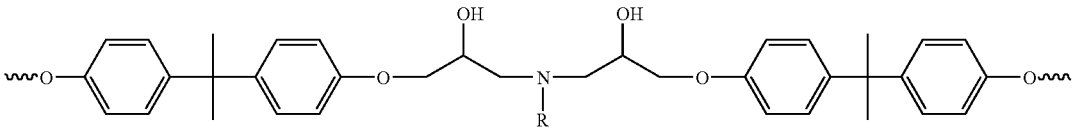

and/or (VIII)

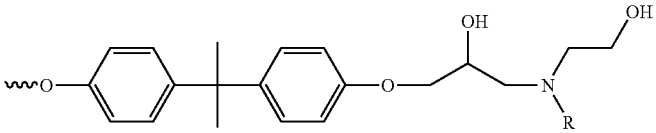

It can be inferred by those skilled in the art from the generally poorer cure response of cationic epoxies containing a preponderance of structural units (VII) and (VIII), that the hydroxyl groups beta to phenoxy groups on the backbone of (VII) and near the end of structural unit (VIII) do not effectively participate in cure, i.e. they are not completely converted to electron-withdrawing urethane groups during the curing step. Also, it should here be noted that the degree of consumption of basic nitrogen by reaction with the polyisocyanate curing agent can be measured by titration of the cryogenically ground electrodepositable composition after the curing step as described above.

If desired, a minor amount of the polymer(s) having the structural units (VII) and/or (VIII) can be included in the electrodepositable coating compositions of the present invention, provided that such polymers are not present in an amount sufficient to negatively affect photodegradation resistance of the cured electrodeposited coating.

The active hydrogen-containing, terminal amino group-containing polymer is rendered cationic and water dispersible by at least partial neutralization with an acid. Suitable acids include organic and inorganic acids such as formic acid, acetic acid, lactic acid, phosphoric acid, dimethylolpropionic acid, and sulfamic acid. Mixtures of acids can be used. The extent of neutralization varies with the particular reaction product involved. However, sufficient acid should be used to disperse the electrodepositable composition in water. Typically, the amount of acid used provides at least 30 percent of the total theoretical neutralization. Excess acid may also be used beyond the amount required for 100 percent total theoretical neutralization.

The extent of cationic salt group formation should be such that when the polymer is mixed with an aqueous medium and the other ingredients, a stable dispersion of the electrodepositable composition will form. By "stable dispersion" is meant one that does not settle or is easily redispersible if some settling occurs. Moreover, the dispersion should be of sufficient cationic character that the dispersed particles will migrate toward and electrodeposit on a cathode when an electrical potential is set up between an anode and a cathode immersed in the aqueous dispersion.

Generally, the cationic polymer is ungelled and contains from about 0.1 to 3.0, preferably from about 0.1 to 0.7 millequivalents of cationic salt group per gram of polymer solids.

The active hydrogens associated with the cationic polymer include any active hydrogens which are reactive with isocyanates within the temperature range of about 93° C. to 204° C., preferably about 121° C. to 177° C. Typically, the active hydrogens are selected from the group consisting of hydroxyl and primary and secondary amino, including mixed groups such as hydroxyl and primary amino. Preferably, the polymer will have an active hydrogen content of about 1.7 to 10 millequivalents, more preferably about 2.0 to 5 millequivalents of active hydrogen per gram of polymer solids.

The cationic salt group-containing polymer can be present in the photodegradation-resistant electrodepositable composition used in the processes of the present invention in an amount ranging from 20 to 80 percent, often from 30 to 75 percent by weight, and typically from 50 to 70 percent by weight based on the total combined weight of resin solids of the cationic salt group-containing polymer and the curing agent.

As mentioned above, the resinous phase of the photodegradation-resistant electrodepositable coating composition further comprises a curing agent (2) adapted to react with the active hydrogen groups of the cationic electrodepositable resin described immediately above. In one embodiment of the present invention, the curing agent comprises one or more at least partially blocked aliphatic polyisocyanates. In this embodiment, a minor amount (i.e. less than 10, preferably less than 5 weight percent of total resin solids of the curing agent present in the composition) of aromatic polyisocyanate can be included, provided that the aromatic polyisocyanate is not present in an amount sufficient to deleteriously affect the photodegradation resistance of the cured electrodeposited composition.

The aliphatic polyisocyanates can be fully blocked as described in U.S. Pat. No. 3,984,299 column 1 lines 1 to 68, column 2 and column 3 lines 1 to 15, or partially blocked and reacted with the polymer backbone as described in U.S. Pat. No. 3,947,338 column 2 lines 65 to 68, column 3 and column 4 lines 1 to 30. In one embodiment of the present invention, the polyisocyanate curing agent is a fully blocked polyisocyanate with substantially no free isocyanate groups.

Diisocyanates typically are used, although higher polyisocyanates can be used in lieu of or in combination with diisocyanates. Examples of aliphatic polyisocyanates suitable for use as curing agents include cycloaliphatic and araliphatic polyisocyanates such as 1,6-hexamethylene diisocyanate, isophorone diisocyanate, bis-(isocyanatocyclohexyl)methane, polymeric 1,6-hexamethylene diisocyanate, trimerized isophorone diisocyanate, norbornane diisocyanate and mixtures thereof. In a particular embodiment of the present invention, the curing agent comprises a fully blocked polyisocyanate selected from a polymeric 1,6-hexamethylene diisocyanate, isophorone diisocyanate, and mixtures thereof. In another embodiment of the present invention the polyisocyanate curing agent comprises a fully blocked trimer of hexamethylene diisocyanate available as Desmodur N3300® from Bayer Corporation.

In one embodiment of the present invention, the aliphatic polyisocyanate curing agent is at least partially blocked with at least one blocking agent selected from a 1,2-alkane diol, for example 1,2-propanediol, a 1,3-alkane diol, for example 1,3-butanediol, a benzylic alcohol, for example, benzyl alcohol, an allylic alcohol, for example, allyl alcohol, caprolactam, a dialkylamine, for example dibutylamine, and mixtures thereof. In a further embodiment of the present invention, the aliphatic polyisocyanate curing agent is at least partially blocked with at least one 1,2-alkane diol having three or more carbon atoms, for example 1,2-butanediol.

If desired, the blocking agent can further comprise minor amounts of other well known blocking agents such as aliphatic, cycloaliphatic, or aromatic alkyl monoalcohol or phenolic compound, including, for example, lower aliphatic alcohols such as methanol, ethanol, and n-butanol; cycloaliphatic alcohols such as cyclohexanol; aromatic-alkyl alcohols such as phenyl carbinol and methylphenyl carbinol; and phenolic compounds such as phenol itself and substituted phenols wherein the substituents do not affect coating operations, such as cresol and nitrophenol. Glycol ethers and glycol amines may also be used as blocking agents. Suitable glycol ethers include ethylene glycol butyl ether, diethylene glycol butyl ether, ethylene glycol methyl ether and propylene glycol methyl ether. Other suitable blocking agents include oximes such as methyl ethyl ketoxime, acetone oxime and cyclohexanone oxime. As mentioned above, these conventional blocking agents can be used in minor amounts provided that they are not present in amounts sufficient to deleteriously affect photodegradation resistance of the cured electrodeposited coating.

The at least partially blocked polyisocyanate curing agent (2) can be present in the photodegradation-resistant electrodepositable composition used in the processes of the present invention in an amount ranging from 80 to 20 percent, often from 75 to 30, and typically from 70 to 50 percent by weight, based on the total combined weight of resin solids of the cationic salt group-containing polymer and the curing agent.

Suitable photodegradation-resistant electrodeposition coating compositions are described in U.S. patent application Ser. No. 10/005,830, incorporated herein by reference.

Any of the electrodepositable coating compositions suitable for use in the processes of the present invention, typically further comprise other optional ingredients. For example, the resinous binder is dispersed in an aqueous media which comprises primarily water. Besides water, the aqueous medium may contain a coalescing solvent, for example, hydrocarbons, alcohols, esters, ethers and ketones. such as isopropanol, butanol, 2-ethylhexanol, isophorone, 2-methoxypentanone, ethylene and propylene glycol and the monoethyl, monobutyl and monohexyl ethers of ethylene glycol. A pigment composition, for example, those described below with reference to the basecoating compositions, and, if desired, various additives such as surfactants, wetting agents or catalysts also can be included in the dispersion. Other ingredients can include corrosion inhibitive materials, for example, rare earth metal compound, such as soluble, insoluble, organic and inorganic salts of rare earth metals such as, inter alia, yttrium, bismuth, zirconium, and tungsten. Also, hindered amine light stabilizers and/or ultraviolet light absorbers can be included in the electrodepositable coating compositions.

In the processes of the present invention, any of the curable electrodepositable coating compositions described above can be electrophoretically deposited onto at least a portion of any of a variety of electroconductive substrates, including various metallic substrates. Suitable metallic substrates can include ferrous metals and non-ferrous metals. Suitable ferrous metals include iron, steel, and alloys thereof. Non-limiting examples of useful steel materials include cold-rolled steel, galvanized (i.e., zinc coated) steel, electrogalvanized steel, stainless steel, pickled steel, GALVANNEAL®, GALVALUME®, AND GALVAN® zinc-aluminum alloys coated upon steel, and combinations thereof. Useful non-ferrous metals include conductive carbon coated materials, aluminum, copper, zinc, magnesium and alloys thereof. Cold rolled steel also is suitable when pretreated with a solution such as a metal phosphate solution, an aqueous solution containing at least one Group IIIB or IVB metal, an organophosphate solution, an organophosphonate solution and combinations of the above as are discussed below. Combinations or composites of ferrous and non-ferrous metals can also be used.

In one embodiment, the process of the present invention further comprises the step of forming a basecoat over the electrodeposition coating layer by depositing an aqueous curable basecoating composition directly onto at least a portion of the electrodeposition coating layer. The basecoating composition typically comprise an aqueous basecoating composition such as any of the aqueous basecoating compositions well known in the art.

As used herein, by applying a composition "onto" or "directly onto" at least a portion of a substrate or previously formed coating layer is meant that the composition is applied onto the substrate or coating layer and is in surface contact with the substrate or coating layer, with no intervening coating layer(s).

The aqueous basecoating compositions useful in the processes of the present invention typically comprise (i) a resinous binder comprising a polymer, which typically comprises reactive functional groups; and (ii) a pigment composition comprising one or more pigments dispersed in the resinous binder (i). The polymer can serve as a main film-forming polymer of the basecoating composition, it can serve as a pigment grind vehicle, or both.

The polymer which comprises the first resin binder (or the second resinous binder as described below) (i) can be selected from any of a variety of polymers known in the art, for example those polymers selected from the group consisting of an acrylic polymer, a polyester polymer, a polyurethane polymer, a polyether polymer, a polyepoxide polymer, a silicon-containing polymer, mixtures thereof, and copolymers thereof, for example, "hybrid" resinous binders such as a polymer prepared by co-polymerizing one or more ethylenically unsaturated monomers (such as any of those described below) in the presence of a polyester polymer (as described in detail below). As used herein, by "silicon-containing polymers" is meant a polymer comprising one or more —SiO— units in the backbone. Such silicon-based polymers can include hybrid polymers, such as those comprising organic polymeric blocks with one or more —SiO— units in the backbone. The resinous binder (i) also usually comprises a curing agent having functional groups reactive with the functional groups of the film-forming polymer.

The polymer can comprise at least one reactive functional group selected from a hydroxyl group, a carboxyl group, an isocyanate group, a blocked isocyanate group, a primary amine group, a secondary amine group, an amide group, a carbamate group, a urea group, a urethane group, a vinyl group, an unsaturated ester group, a maleimide group, a fumarate group, an anhydride group, a hydroxy alkylamide group, an epoxy group, and mixtures of such groups. For example, suitable hydroxyl group-containing polymers can include acrylic polyols, polyester polyols, polyurethane polyols, polyether polyols, and mixtures thereof.

Suitable hydroxyl group and/or carboxyl group-containing acrylic polymers can be prepared from polymerizable ethylenically unsaturated monomers and are typically copolymers of (meth)acrylic acid and/or hydroxylalkyl esters of (meth) acrylic acid with one or more other polymerizable ethylenically unsaturated monomers such as alkyl esters of (meth) acrylic acid including methyl(meth)acrylate, ethyl(meth) acrylate, butyl(meth)acrylate and 2-ethyl hexylacrylate, and vinyl aromatic compounds such as styrene, alpha-methyl styrene, and vinyl toluene. As used herein, "(meth)acrylate" and like terms is intended to include both acrylates and methacrylates.

In a one embodiment of the present invention the acrylic polymer can be prepared from ethylenically unsaturated, beta-hydroxy ester functional monomers. Such monomers can be derived from the reaction of an ethylenically unsaturated acid functional monomer, such as monocarboxylic acids, for example, acrylic acid, and an epoxy compound which does not participate in the free radical initiated polymerization with the unsaturated acid monomer. Examples of such epoxy compounds include glycidyl ethers and esters. Suitable glycidyl ethers include glycidyl ethers of alcohols and phenols such as butyl glycidyl ether, octyl glycidyl ether, phenyl glycidyl ether and the like. Suitable glycidyl esters include those which are commercially available from Shell Chemical Company under the tradename CARDURA E; and from Exxon Chemical Company under the tradename GLYDEXX-10. Alternatively, the beta-hydroxy ester functional monomers can be prepared from an ethylenically unsaturated, epoxy functional monomer, for example glycidyl (meth)acrylate and allyl glycidyl ether, and a saturated carboxylic acid, such as a saturated monocarboxylic acid, for example isostearic acid.

Epoxy functional groups can be incorporated into the polymer prepared from polymerizable ethylenically unsaturated monomers by copolymerizing oxirane group-containing monomers, for example glycidyl(meth)acrylate and allyl glycidyl ether, with other polymerizable ethylenically unsaturated monomers, such as those discussed above. Preparation of such epoxy functional acrylic polymers is described in detail in U.S. Pat. No. 4,001,156 at columns 3 to 6, incorporated herein by reference.

Carbamate functional groups can be incorporated into the polymer prepared from polymerizable ethylenically unsaturated monomers by copolymerizing, for example, the above-described ethylenically unsaturated monomers with a carbamate functional vinyl monomer such as a carbamate functional alkyl ester of methacrylic acid. Useful carbamate functional alkyl esters can be prepared by reacting, for example, a hydroxyalkyl carbamate, such as the reaction product of ammonia and ethylene carbonate or propylene carbonate, with methacrylic anhydride. Other useful carbamate functional vinyl monomers include, for instance, the reaction product of hydroxyethyl methacrylate, isophorone diisocyanate, and hydroxypropyl carbamate; or the reaction product of hydroxypropyl methacrylate, isophorone diisocyanate, and methanol. Still other carbamate functional vinyl monomers may be used, such as the reaction product of isocyanic acid (HNCO) with a hydroxyl functional acrylic or methacrylic monomer such as hydroxyethyl acrylate, and those described in U.S. Pat. No. 3,479,328, incorporated herein by reference. Carbamate functional groups can also be incorporated into the acrylic polymer by reacting a hydroxyl functional acrylic polymer with a low molecular weight alkyl carbamate such as methyl carbamate. Pendant carbamate groups can also be incorporated into the acrylic polymer by a "transcarbamoylation" reaction in which a hydroxyl functional acrylic polymer is reacted with a low molecular weight carbamate derived from an alcohol or a glycol ether. The carbamate groups exchange with the hydroxyl groups yielding the carbamate functional acrylic polymer and the original alcohol or glycol ether. Also, hydroxyl functional acrylic polymers can be reacted with isocyanic acid to provide pendent carbamate groups. Likewise, hydroxyl functional acrylic polymers can be reacted with urea to provide pendent carbamate groups.

The polymers prepared from polymerizable ethylenically unsaturated monomers can be prepared by solution polymerization techniques, which are well-known to those skilled in the art, in the presence of suitable catalysts such as organic peroxides or azo compounds, for example, benzoyl peroxide or N,N-azobis(isobutylronitrile). The polymerization can be carried out in an organic solution in which the monomers are soluble by techniques conventional in the art. Alternatively, these polymers can be prepared by aqueous emulsion or dispersion polymerization techniques which are well-known in the art. The ratio of reactants and reaction conditions are selected to result in an acrylic polymer with the desired pendent functionality.

Polyester polymers are also useful in the coating compositions of the invention as the film-forming polymer. Useful polyester polymers typically include the condensation products of polyhydric alcohols and polycarboxylic acids. Suitable polyhydric alcohols can include ethylene glycol, neopentyl glycol, trimethylol propane, and pentaerythritol. Suitable polycarboxylic acids can include adipic acid, 1,4-cyclohexyl dicarboxylic acid, and hexahydrophthalic acid. Besides the polycarboxylic acids mentioned above, functional equivalents of the acids such as anhydrides where they exist or lower alkyl esters of the acids such as the methyl esters can be used. Also, small amounts of monocarboxylic acids such as stearic acid can be used. The ratio of reactants and reaction conditions are selected to result in a polyester polymer with the desired pendent functionality, i.e., carboxyl or hydroxyl functionality.

For example, hydroxyl group-containing polyesters can be prepared by reacting an anhydride of a dicarboxylic acid such as hexahydrophthalic anhydride with a diol such as neopentyl glycol in a 1:2 molar ratio. Where it is desired to enhance air-drying, suitable drying oil fatty acids may be used and include those derived from linseed oil, soya bean oil, tall oil, dehydrated castor oil, or tung oil.

Carbamate functional polyesters can be prepared by first forming a hydroxyalkyl carbamate that can be reacted with the polyacids and polyols used in forming the polyester. Alternatively, terminal carbamate functional groups can be incorporated into the polyester by reacting isocyanic acid with a hydroxy functional polyester. Also, carbamate functionality can be incorporated into the polyester by reacting a hydroxyl polyester with a urea. Additionally, carbamate groups can be incorporated into the polyester by a transcarbamoylation reaction. Preparation of suitable carbamate functional group-containing polyesters are those described in U.S. Pat. No. 5,593,733 at column 2, line 40 to column 4, line 9, incorporated herein by reference.

In one embodiment of the present invention, the first basecoating composition can comprise less than 50 weight percent, may comprise less than 40 weight percent, and may comprise less than 30 weight percent of a hybrid resin prepared by co-polymerizing one or more polymerizable ethylenically unsaturated monomers, such as any of those previously discussed with respect to the acrylic polymers, in the presence of one or more polyester polymers, such as any of those described immediately above.

Polyurethane polymers containing terminal isocyanate or hydroxyl groups also can be used as the polymer (d) in the coating compositions of the invention. The polyurethane polyols or NCO-terminated polyurethanes which can be used are those prepared by reacting polyols including polymeric polyols with polyisocyanates. Polyureas containing terminal isocyanate or primary and/or secondary amine groups which also can be used are those prepared by reacting polyamines including polymeric polyamines with polyisocyanates. The hydroxyl/isocyanate or amine/isocyanate equivalent ratio is adjusted and reaction conditions are selected to obtain the desired terminal groups. Examples of suitable polyisocyanates include those described in U.S. Pat. No. 4,046,729 at column 5, line 26 to column 6, line 28, incorporated herein by reference. Examples of suitable polyols include those described in U.S. Pat. No. 4,046,729 at column 7, line 52 to column 10, line 35, incorporated herein by reference. Examples of suitable polyamines include those described in U.S. Pat. No. 4,046,729 at column 6, line 61 to column 7, line 32 and in U.S. Pat. No. 3,799,854 at column 3, lines 13 to 50, both incorporated herein by reference.

Carbamate functional groups can be introduced into the polyurethane polymers by reacting a polyisocyanate with a polyester having hydroxyl functionality and containing pendent carbamate groups. Alternatively, the polyurethane can be prepared by reacting a polyisocyanate with a polyester polyol and a hydroxyalkyl carbamate or isocyanic acid as separate reactants. Examples of suitable polyisocyanates are aromatic isocyanates, such as 4,4'-diphenylmethane diisocyanate, 1,3-phenylene diisocyanate and toluene diisocyanate, and aliphatic polyisocyanates, such as 1,4-tetramethylene diisocyanate and 1,6-hexamethylene diisocyanate. Cycloaliphatic diisocyanates, such as 1,4-cyclohexyl diisocyanate and isophorone diisocyanate also can be employed.

Examples of suitable polyether polyols include polyalkylene ether polyols such as those having the following structural formulas (IX) or (X):

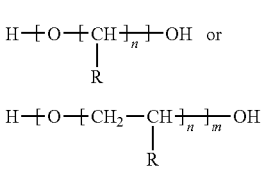

(IX)

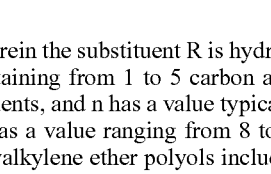

(X)

wherein the substituent R is hydrogen or a lower alkyl group containing from 1 to 5 carbon atoms including mixed substituents, and n has a value typically ranging from 2 to 6 and m has a value ranging from 8 to 100 or higher. Exemplary polyalkylene ether polyols include poly(oxytetramethylene) glycols, poly(oxytetraethylene) glycols, poly(oxy-1,2-propylene) glycols, and poly(oxy-1,2-butylene) glycols.

Also useful are polyether polyols formed from oxyalkylation of various polyols, for example, glycols such as ethylene glycol, 1,6-hexanediol, Bisphenol A, and the like, or other higher polyols such as trimethylolpropane, pentaerythritol, and the like. Polyols of higher functionality which can be utilized as indicated can be made, for instance, by oxyalkylation of compounds such as sucrose or sorbitol. One commonly utilized oxyalkylation method is reaction of a polyol with an alkylene oxide, for example, propylene or ethylene oxide, in the presence of an acidic or basic catalyst. Specific examples of polyethers include those sold under the names TERATHANE and TERACOL, available from E. I. Du Pont de Nemours and Company, Inc.

Polyepoxides such as those described below with reference to the curing agent (described below), can also be used.

In one particular embodiment of the present invention, the resinous binder (i) comprises a polyurethane polymer having a number average molecular weight (Mn) of at least 2000. The number average molecular weight of the polyurethane polymer can range from 2000 to 500,000, typically from 3000 to 200,000.

The film-forming polymer can be present in the basecoating compositions in an amount of at least 2 percent by weight, usually at least 5 percent by weight, and typically at least 10 percent by weight based on weight of total resin solids in the basecoating composition. Also, the polymer having reactive functional groups can be present in the basecoating compositions of the invention in an amount less than 80 percent by weight, usually less than 60 percent by weight, and typically less than 50 percent by weight based on weight of total resin solids in the coating composition. The amount of the film-forming polymer present in the basecoating compositions of the present invention can range between any combination of these values inclusive of the recited values.

As aforementioned, in addition to the functional group-containing polymer, the basecoating compositions used in the processes of the present invention can further comprise at least one curing agent having functional groups reactive with the functional groups of the polymer.

Dependent upon the reactive functional groups of the film-forming polymer, this curing agent can be selected from an aminoplast resin, a polyisocyanate, a blocked isocyanate, a polyepoxide, a polyacid, an anhydride, an amine, a polyol, and mixtures of any of the foregoing. In one embodiment, the at least one curing agent is selected from an aminoplast resin and a polyisocyanate.

Aminoplast resins, which can comprise phenoplasts, as curing agents for hydroxyl, carboxylic acid, and carbamate functional group-containing materials are well known in the art. Suitable aminoplast resins, such as, for example, those discussed above, are known to those of ordinary skill in the art. Aminoplasts can be obtained from the condensation reaction of formaldehyde with an amine or amide. Nonlimiting examples of amines or amides include melamine, urea, or benzoguanamine. Condensates with other amines or amides can be used; for example, aldehyde condensates of glycoluril, which give a high melting crystalline product useful in powder coatings. While the aldehyde used is most often formaldehyde, other aldehydes such as acetaldehyde, crotonaldehyde, and benzaldehyde can be used.

The aminoplast resin contains imino and methylol groups and in certain instances at least a portion of the methylol groups are etherified with an alcohol to modify the cure response. Any monohydric alcohol can be employed for this purpose including methanol, ethanol, n-butyl alcohol, isobutanol, and hexanol.

Nonlimiting examples of aminoplasts include melamine-, urea-, or benzoguanamine-formaldehyde condensates, in certain instances monomeric and at least partially etherified with one or more alcohols containing from one to four carbon atoms. Nonlimiting examples of suitable aminoplast resins are commercially available, for example, from Cytec Industries, Inc. under the trademark CYMEL® and from Solutia, Inc. under the trademark RESIMENE®.

In yet another embodiment of the present invention, the curing agent comprises a polyisocyanate curing agent. As used herein, the term "polyisocyanate" is intended to include blocked (or capped) isocyanates as well as unblocked (poly) isocyanates. The polyisocyanate can be an aliphatic or an aromatic polyisocyanate, or a mixture of the foregoing two. Diisocyanates can be used, although higher polyisocyanates such as isocyanurates of diisocyanates are often used. Higher polyisocyanates also can be used in combination with diisocyanates. Isocyanate prepolymers, for example, reaction products of polyisocyanates with polyols also can be used. Mixtures of polyisocyanate curing agents can be used.

If the polyisocyanate is blocked or capped, any suitable aliphatic, cycloaliphatic, or aromatic alkyl monoalcohol known to those skilled in the art can be used as a capping agent for the polyisocyanate. Other suitable capping agents include oximes and lactams. When used, the polyisocyanate curing agent is typically present, when added to the other components which form the coating composition, in an amount ranging from 0.5 to 65 weight percent, can be present in an amount ranging from 10 to 45 weight percent, and often are present in an amount ranging from 15 to 40 percent by weight based on the total weight of resin solids present in the composition.

Other useful curing agents comprise blocked isocyanate compounds such as, for example, the tricarbamoyl triazine compounds described in detail in U.S. Pat. No. 5,084,541, which is incorporated by reference herein. When used, the blocked polyisocyanate curing agent can be present, when added to the other components in the composition, in an amount ranging up to 20 weight percent, and can be present in an amount ranging from 1 to 20 weight percent, based on the total weight of resin solids present in the composition.

Anhydrides as curing agents for hydroxyl functional group-containing materials also are well known in the art and can be used in the basecoating compositions of the present invention. Nonlimiting examples of anhydrides suitable for use as curing agents in the compositions of the invention include those having at least two carboxylic acid anhydride groups per molecule which are derived from a mixture of monomers comprising an ethylenically unsaturated carboxylic acid anhydride and at least one vinyl co-monomer, for example, styrene, alpha-methyl styrene, vinyl toluene, and the like. Nonlimiting examples of suitable ethylenically unsaturated carboxylic acid anhydrides include maleic anhydride, citraconic anhydride, and itaconic anhydride. Alternatively, the anhydride can be an anhydride adduct of a diene polymer such as maleinized polybutadiene or a maleinized copolymer of butadiene, for example, a butadiene/styrene copolymer. These and other suitable anhydride curing agents are described in U.S. Pat. No. 4,798,746 at column 10, lines 16-50; and in U.S. Pat. No. 4,732,790 at column 3, lines 41-57, both of which are incorporated herein by reference.

Polyepoxides as curing agents for carboxylic acid functional group-containing materials are well known in the art. Nonlimiting examples of polyepoxides suitable for use in the compositions of the present invention comprise polyglycidyl esters (such as acrylics from glycidyl methacrylate), polyglycidyl ethers of polyhydric phenols and of aliphatic alcohols, which can be prepared by etherification of the polyhydric phenol, or aliphatic alcohol with an epihalohydrin such as epichlorohydrin in the presence of alkali. These and other suitable polyepoxides are described in U.S. Pat. No. 4,681,811 at column 5, lines 33 to 58, which is incorporated herein by reference.

Suitable curing agents for epoxy functional group-containing materials comprise polyacid curing agents, such as the acid group-containing acrylic polymers prepared from an ethylenically unsaturated monomer containing at least one carboxylic acid group and at least one ethylenically unsaturated monomer which is free from carboxylic acid groups. Such acid functional acrylic polymers can have an acid number ranging from 30 to 150. Acid functional group-containing polyesters can be used as well. The above-described polyacid curing agents are described in further detail in U.S. Pat. No. 4,681,811 at column 6, line 45 to column 9, line 54, which is incorporated herein by reference.

Also well known in the art as curing agents for isocyanate functional group-containing materials are polyols, that is, materials having two or more hydroxyl groups per molecule, different from component (b) when component (b) is a polyol. Nonlimiting examples of such materials suitable for use in the compositions of the invention include polyalkylene ether polyols, including thio ethers; polyester polyols, including polyhydroxy polyesteramides; and hydroxyl-containing polycaprolactones and hydroxy-containing acrylic copolymers. Also useful are polyether polyols formed from the oxyalkylation of various polyols, for example, glycols such as ethylene glycol, 1,6-hexanediol, Bisphenol A and the like, or higher polyols such as trimethylolpropane, pentaerythritol, and the like. Polyester polyols also can be used. These and other suitable polyol curing agents are described in U.S. Pat. No. 4,046,729 at column 7, line 52 to column 8, line 9; column 8, line 29 to column 9, line 66; and U.S. Pat. No. 3,919,315 at column 2, line 64 to column 3, line 33, both of which are incorporated herein by reference.

Polyamines also can be used as curing agents for isocyanate functional group-containing materials. Nonlimiting examples of suitable polyamine curing agents include primary or secondary diamines or polyamines in which the radicals attached to the nitrogen atoms can be saturated or unsaturated, aliphatic, alicyclic, aromatic, aromatic-substituted-aliphatic, aliphatic-substituted-aromatic, and heterocyclic. Nonlimiting examples of suitable aliphatic and alicyclic diamines include 1,2-ethylene diamine, 1,2-propylene diamine, 1,8-octane diamine, isophorone diamine, propane-2,2-cyclohexyl amine, and the like. Nonlimiting examples of suitable aromatic diamines include phenylene diamines and the toluene diamines, for example, o-phenylene diamine and p-tolylene diamine. These and other suitable polyamines described in detail in U.S. Pat. No. 4,046,729 at column 6, line 61 to column 7, line 26, which is incorporated herein by reference.

When desired, appropriate mixtures of curing agents may be used. It should be mentioned that the basecoating compositions can be formulated as a one-component composition where a curing agent such as an aminoplast resin and/or a blocked isocyanate compound such as those described above is admixed with other composition components. The one-component composition can be storage stable as formulated. Alternatively, compositions can be formulated as a two-component composition, for example, where a polyisocyanate curing agent such as those described above can be added to a pre-formed admixture of the other composition components just prior to application. The pre-formed admixture can comprise curing agents such as aminoplast resins and/or blocked isocyanate compounds such as those described above.

As previously mentioned, the basecoating compositions useful in the processes of the present invention further comprise (ii) a pigment composition. The pigment composition (ii) can include filler pigments, for example, talc and calcium carbonate; color-enhancing pigments, for example, inorganic pigments such as titanium dioxide, red and black iron oxides, chromium oxide, lead chromate, and carbon black, and/or organic pigments such as phthalocyanine blue and phthalocyanine green; and effect-enhancing pigments, for example, metallic pigments such as aluminum flake, copper or bronze flake, and metal oxide coated micaceous pigments. Any of the basecoating compositions used in the processes of the present invention can comprise one or more filler pigments, color-enhancing pigments, and/or effect-enhancing pigments, and combinations thereof.

In another embodiment of the present invention, the basecoating compositions useful in the processes of the present invention further comprise an aqueous dispersion of polymeric microparticles, typically crosslinked polymeric microparticles. Such crosslinked microparticles can be prepared, for example, the non-aqueous dispersion method comprising polymerizing a mixture of ethylenically unsaturated co-monomers at least one of which is a crosslinking co-monomer, in an organic liquid in which the mixture is soluble but the resultant polymer is insoluble. Most often, the polymeric microparticles used in the basecoating compositions of the present invention can be prepared by emulsion polymerization of a mixture of ethylenically unsaturated co-monomers which can include a crosslinkable monomer in an aqueous medium by methods well known in the art. The ethylenically unsaturated co-monomers can be polymerized in the presence of a polymer, typically a hydrophobic polymer, for example a hydrophobic acrylic, polyester, and/or a polyurethane polymer. By "crosslinkable monomer" is meant a polymerizable ethylenically monomer having at least two polymerizable ethylenically unsaturated bonds in the molecule, or, alternatively, a combination of two different monomers having mutually reactive groups. Specific examples of such crosslinkable monomers include ethylene glycol di(meth)acrylate, hexanediol di(meth)acrylate, trimethylolpropane tri(meth)acrylate, divinyl benzene, and a combination of an epoxy functional monomer such as glycidyl(meth) acrylate and a carboxylic acid functional monomer such as (meth)acrylic acid. Suitable, but non-limiting examples of polymeric microparticles are those described in U.S. Pat. Nos. 5,071,904; 4,728,545; 4,539,363; and 4,403,003.

The first and/or second basecoating compositions useful in the processes of the present invention can comprise one or more aqueous dispersions of polymeric microparticles, usually crosslinked polymeric microparticles, in an amount up to 75 weight percent, sometimes up to 70 weight percent, sometimes up to 60 weight percent, and sometimes up to 55. The basecoating compositions also can comprise one or more aqueous dispersions of polymicroparticles, usually crosslinked polymeric microparticles, in an amount equal to or greater than 20 weight percent, sometimes equal to or greater than 25 weight percent, sometimes equal to or greater than 30 weight percent, and sometimes equal to or greater than 35 weight percent. The amount of aqueous dispersion of polymeric microparticles present in the basecoating compositions useful in the processes of the present invention, can range between any of the above-stated levels, inclusive of the recited values.

In addition to the components described above, any of the basecoating compositions used in the processes of the present invention can contain a variety of other optional ingredients. If desired, other resinous materials can be included in conjunction with the aforedescribed polymers, curing agents and aqueous polymeric microparticles so long as the resultant multilayer composite coating is not detrimentally affected in terms of physical performance and appearance properties. Likewise the basecoating composition can include additive materials, for example, rheology control agents, hindered amine light stabilizers and/or ultraviolet light absorbers, catalysts, fillers, surfactants and the like.

Once the basecoating composition has been applied directly onto at least a portion of the electrodeposition coating layer to form a basecoating layer thereon, the basecoating layer, optionally, is dehydrated, typically by heating to a temperature and for a time sufficient to drive off excess solvents, for example, water, but insufficient to cure the basecoating layer. Dehydration of the basecoating layer also can be accomplished by giving the basecoated substrate a flash period at ambient conditions to for a time sufficient to allow solvent to evaporate from the coating layer. Suitable dehydration conditions will depend on the particular basecoating and top coating compositions employed and on the ambient humidity, but in general, a dehydration time of from 1 to 5 minutes at a temperature of 80° F. to 250° F. (20° C. to 121° C.) is sufficient. If a flash period is used in lieu of or in combination with thermal dehydration conditions, the basecoating layer can be exposed to ambient conditions for a period of from 1 to 20 minutes.

The process further comprises forming a top coating layer on the basecoating layer by depositing a curable top coating composition which is substantially pigment-free directly onto at least a portion of the uncured basecoating layer (in a wet-on-wet application). The substantially pigment-free top coating compositions used in any of the processes of the present invention can include aqueous coating compositions, solvent-based compositions, and compositions in solid particulate form, i.e., powder coating compositions. Any of the transparent or clear coating compositions known in the art are suitable for this purpose. Suitable non-limiting examples include the clear coating compositions described in U.S. Pat. Nos. 4,650,718; 5,814,410; 5,891,981; and WO 98/14379. Specific non-limiting examples include TKU-1050AR, ODCT8000, and those available under the tradenames DIAMOND COAT® and NCT®, all commercially available from PPG Industries, Inc.

As used herein, by "substantially pigment-free" coating composition is meant a coating composition which forms a transparent coating, such as a clearcoat. Such compositions are sufficiently free of pigment or particles such that the optical properties of the resultant coatings are not seriously compromised. As used herein, "transparent" means that the cured coating has a BYK Haze index of less than 50 as measured using a BYK/Haze Gloss instrument.

Once the top coating layer (i.e., the clearcoating layer) has been formed on at least a portion of the basecoating layer, the coated substrate is subjected to conditions sufficient to simultaneously cure the top coating layer, the basecoating layer, and, optionally, the electrodeposition layer. In the curing operation, solvents are driven off and the film-forming materials of the various coating layers are each crosslinked. Curing of the coating layers can be accomplished by any known curing methods including by thermal energy, infrared, ionizing or actinic radiation, or by any combination thereof. Generally, the curing operation can be carried out at temperatures ranging from 50° F. to 475° F. (10° C. to 246° C.), however, lower or higher temperatures may be used as necessary to activate crosslinking mechanisms. Cure is as defined above.

In another embodiment, the present invention is directed to a process for forming a multilayer composite coating on a substrate, the process comprising: forming a first basecoating layer over the substrate by depositing an aqueous curable first basecoating composition over at least a portion of the substrate, optionally, dehydrating the first basecoating layer, forming a second basecoating layer over the first basecoating layer by depositing an aqueous curable second basecoating composition, which is the same or different from the first basecoating composition, directly onto at least a portion of the first basecoating layer, optionally, dehydrating the second basecoating layer, forming a top coating layer over the second basecoating layer by depositing a curable top coating composition which is substantially pigment-free directly onto at least a portion of the second basecoating layer; and curing the top coating layer, the second basecoating layer, and the first basecoating layer simultaneously.

In this embodiment, the first basecoating composition can be applied directly onto the substrate surface of a non-metallic substrate or a metallic substrate with no intervening electrodeposition coating layer. That is, the first basecoating composition can be applied directly to the "bare metal" surface of a metallic substrate (as described above) or to a metallic substrate to which a pretreatment or weldable primer coating composition has previously applied (as described above with reference to application of the electrodepositable coating composition). It also should be understood that for purposes of this embodiment, applying the first basecoating composition "over at least a portion of the substrate" does not preclude the previous application and optional curing of an electrodepositable coating composition over at least a portion of the substrate prior to application of the first basecoating composition.

As aforementioned, the substrate also can comprise a nonmetallic substrate, for example, an "elastomeric" substrate. Suitable elastomeric substrates can include any of the thermoplastic or thermoset synthetic materials well known in the art. Nonlimiting examples of suitable flexible elastomeric substrate materials include polyethylene, polypropylene, thermoplastic polyolefin ("TPO"), reaction injected molded polyurethane ("RIM") and thermoplastic polyurethane ("TPU").

Nonlimiting examples of thermoset materials useful as substrates in connection with the present invention include polyesters, epoxides, phenolics, polyurethanes such as "RIM" thermoset materials, and mixtures of any of the foregoing. Nonlimiting examples of suitable thermoplastic materials include thermoplastic polyolefins such as polyethylene, polypropylene, polyamides such as nylon, thermoplastic polyurethanes, thermoplastic polyesters, acrylic polymers, vinyl polymers, polycarbonates, acrylonitrile-butadiene-styrene ("ABS") copolymers, ethylene propylene diene terpolymer ("EPDM") rubber, copolymers, and mixtures of any of the foregoing.

If desired, the elastomeric substrates described above can have an adhesion promoter present on the surface of the substrate over which any of a number of coating compositions (including the coating compositions of the present invention as described below) can be applied. To facilitate adhesion of organic coatings to such polymeric substrates, the substrate can be pretreated using an adhesion promoter layer or tie coat, e.g., a thin layer 0.25 mils (6.35 microns) thick, or by flame or corona pretreatment.

Suitable adhesion promoters for use over polymeric substrates include chlorinated polyolefin adhesion promoters such as are described in U.S. Pat. Nos. 4,997,882; 5,319,032; and 5,397,602, incorporated by reference herein. Other useful adhesion promoting coatings are disclosed in U.S. Pat. No. 6,001,469 (a coating composition containing a saturated polyhydroxylated polydiene polymer having terminal hydroxyl groups), U.S. Pat. No. 5,863,646 (a coating composition having a blend of a saturated polyhydroxylated polydiene polymer and a chlorinated polyolefin) and U.S. Pat. No. 5,135,984 (a coating composition having an adhesion promoting material obtained by reacting a chlorinated polyolefin, maleic acid anhydride, acryl or methacryl modified hydrogenated polybutadiene containing at least one acryloyl group or methacryloyl group per unit molecule, and organic peroxide), which are incorporated herein by reference.

When the substrates are used as components to fabricate motor vehicles (including, but not limited to, automobiles, trucks and tractors) they can have any shape, and can be selected from the metallic and/or non-metallic substrates described above. Typical shapes of automotive body components can include body side moldings, fenders, bumpers, hoods, and trim for automotive vehicles.

In any of the processes of the present invention, the second basecoating composition can be the same or different from the first basecoating composition. The second basecoating composition comprises (i) a second resinous binder composition and (ii) a second pigment composition dispersed in the second resinous binder. The second resinous binder composition can be the same or different from the first resinous binder composition; and, likewise, the second pigment composition can be the same or different from the first pigment composition.

The second resinous binder composition can comprise a film-forming polymer selected from an acrylic polymer, a polyester polymer, a polyurethane polymer, a polyether polymer, a polyepoxide polymer, a silicon-containing polymer, mixtures thereof, and copolymers thereof, such as those described above in detail with reference to the first resinous binder composition. In one embodiment of the present invention, the first resinous binder composition and the second resinous binder composition comprise the same or different polyurethane polymer (such as any of the above-described polyurethane polymers). In an alternative embodiment, the first resinous binder composition and the second resinous binder composition comprise the same or different polyurethane polymer, wherein the concentration of the polyurethane polymer in the first basecoating composition is less than or equal to the concentration of the polyurethane polymer present in the second basecoating composition, where concentrations are based on total resin solids present in the basecoating compositions.

As previously mentioned, in any of the processes of the present invention where both first and second basecoating compositions are employed, the second pigment composition can be the same or different from the first pigment composition. The second pigment composition can comprise any of the filler pigments, color-enhancing pigments and/or effect-enhancing pigments described in detail above with respect to the first pigment composition. In one embodiment, the second basecoating composition comprises color-enhancing and/or effect enhancing pigments.

In a further embodiment, the present invention is directed to a process for forming a multilayer composite coating on any of the previously described metallic substrates, the process comprising: forming an electrodeposition coating layer on the substrate by electrodeposition of a curable electrodepositable coating composition, such as any of the above-described electrodepositable coating compositions, over at least a portion of the substrate; optionally, heating the coated substrate to a temperature and for a time sufficient to cure the electrodeposition coating layer; forming a first basecoating layer over the electrodeposition coating layer by depositing an aqueous curable first basecoating composition (such as any of the basecoating compositions described above) directly onto at least a portion of the electrodeposition coating layer, optionally, dehydrating the first basecoating layer; forming a second basecoating layer over the first basecoating layer by depositing an aqueous curable second basecoating composition (such as any of the basecoating compositions described above), which is the same or different from the first basecoating composition, directly onto at least a portion of the first basecoating layer, optionally, dehydrating the second basecoating layer; forming a top coating layer over the second basecoating layer by depositing a curable top coating composition (such as any of the clear coating compositions described above) which is substantially pigment-free directly onto at least a portion of the second basecoating layer; and curing the top coating layer, the second basecoating layer, the first basecoating layer, and, optionally, the electrodeposition coating layer simultaneously.

The first and second basecoating compositions, or in instances where the basecoating composition is used to form only one basecoating layer over a metal substrate or directly onto an electrodeposition coating layer, have a pigment to binder ratio based on solids content ranging 0.1 to 4.0:1, usually from 0.1 to 3.0:1, and typically from 0.1 to 2.0:1. It should be understood that the pigment to binder ratio of the basecoating composition can vary widely dependent upon the composition, the pigment type, and/or the color desired.

Also, the film thickness of the cured first and second basecoating layers (or, alternatively, the sole basecoating layer where applicable) can range from 1 to 50, usually from 5 to 30, and often from 10 to 25 micrometers. Likewise, it should be understood that the film thickness of the cured basecoating layer can vary widely dependent upon the basecoating composition as well as the basecoat color or pigmentation.

In any of the processes of the present invention where first and second basecoating compositions are employed, the first and second basecoating layers can be color-harmonized. That is, despite compositional differences in resinous binder and/or pigment compositions (if such compositional differences exist), the first and second basecoating layers when cured are sufficiently similar in color that the cured second basecoating layer can have a film thickness significantly less than that of the cured first basecoating layer without deleteriously effecting appearance properties of the multilayer composite coating.

In another embodiment of the present invention, the cured first basecoating layer (or, alternatively, the sole basecoating layer where applicable) has 5 percent or less light transmission as measured at 400 nanometers at a film thickness of 15 micrometers. For purposes of the present invention, the percent light transmission is determined by measuring light transmission of free cured basecoat films ranging from 14 to 16 micrometers film thickness, using a Perkin-Elmer Lambda 9 scanning spectrophotometer with a 150 millimeter Lap Sphere integrating sphere. Data is collected using Perkin-Elmer UV WinLab software in accordance with ASTM E903, Standard Test Method for Solar Absorbance, Reflectance, and Transmittance of Materials Using Integrating Spheres.

In any of the processes of the present invention which comprise the sequential steps of applying any of the aforedescribed first basecoating compositions over the substrate or, alternatively, directly onto at least a portion of the electrodeposition coating layer, to form a first basecoating layer thereon; optionally, dehydrating the first basecoating layer; and applying any of the aforedescribed second basecoating compositions, which are different from the first basecoating composition, directly onto the first basecoating layer to form a second basecoating layer thereon, the first basecoating composition can further comprise a composition comprising the second pigment composition dispersed in the second resinous binder. The composition comprising the second pigment composition dispersed in the second resinous binder can be admixed with the first basecoating composition immediately prior to deposition of the first basecoating composition over the substrate or, alternatively, directly onto the electrodeposition coating layer. In this embodiment, it should be understood that the "composition comprising the second pigment composition dispersed in the second resinous binder" can include any of the fully formulated second basecoating compositions, or, alternatively, a pigment paste composition which comprises the second pigment composition dispersed in a second resinous binder comprising a polymer, for example a grind vehicle. It should also be understood that in this embodiment, the first basecoating layer can be formed from a first basecoating composition which comprises a greater proportion of the first basecoating composition with which has been admixed a smaller proportion of the second basecoating composition, or vice versa.

Additionally, in one embodiment of the invention the first and/or second basecoat compositions can be formed by dynamically mixing selected components of the basecoat compositions. Further, the basecoat composition applied in the cut-in station can be formed by dynamically mixing the first and second basecoat compositions. Suitable dynamic mixing apparatus and methods are described in U.S. Pat. Nos. 6,291,018 and 6,296,706, which are herein incorporated by reference in their entirety.

In yet a further embodiment of the present invention, any of the previously described basecoating compositions can be applied over at least a portion of a substrate, or alternatively, directly onto at least a portion of a previously formed electrodeposition coating layer (as described above), to form a single basecoating layer thereon; optionally, the basecoating layer is dehydrated but not cured; a substantially pigment-free top coating composition (such as any of the previously applied clear coating compositions) is applied directly onto at least a portion of the basecoating layer to form a clear top coating layer thereon; and the coated substrate is subjected to conditions sufficient to cure the top coat layer, the basecoat layer, and, optionally, the electrodeposition layer. In this embodiment, the top coating composition is applied directly onto one basecoating layer in a wet-on-wet application.

The processes of the present invention provide multilayer composite coatings which have excellent appearance and physical properties, and are particularly suitable for use in the coating of motor vehicles, for example, automobiles and trucks. In a particular embodiment, the multilayer composite coating formed by any of the processes of the present invention described herein has a chip resistance rating ranging from 4 to 10, typically from 6 to 10, as determined in accordance with ASTM D 3170-01.

The present invention also is directed to an improved process for forming a multilayer composite coating on a motor vehicle substrate comprising the sequential steps of:

(1) passing a conductive motor vehicle substrate to an electrocoating station located on a coating line;

(2) electrocoating the substrate serving as a charged electrode in an electrical circuit comprising said electrode and an oppositely charged counter electrode, said electrodes being immersed in an aqueous electrodepositable composition (such as any of the previously described electrodepositable coating compositions), comprising passing electric current between said electrodes to cause deposition of the electrodepositable composition on the substrate as a substantially continuous film of electrodeposition coating;

(3) passing the coated substrate of step (2) through an electrodeposition coating curing station located on the coating line to cure the electrodepositable composition on the substrate, forming an electrodeposition coating layer thereon;

(4) passing the coated substrate of step (3) to a primer-surfacer coating station located on the coating line;

(5) applying a primer-surfacer coating composition directly to at least a portion of the electrodeposition coating layer to form a primer-surfacer coating layer thereon;

(6) passing the coated substrate of step (5) through a primer-surfacer curing station located on the coating line to cure the primer-surfacer coating layer;

(7) passing the coated substrate of step (6) to a basecoating station located on the coating line;

(8) applying an aqueous basecoating composition directly onto at least a portion of the primer-surfacer coating layer to form a basecoating layer thereon;

(9) optionally, passing the coated substrate of step (8) through a flash oven located on the coating line to dehydrate but not cure the basecoating layer;

(10) passing the coating substrate of step (8), or optionally step (9), to a clearcoating station located on the coating line;

(11) applying a substantially pigment-free coating composition (such as any of the previously described transparent or clear coating compositions) directly onto at least a portion of the basecoating layer to form a clearcoating layer thereon; and

(12) passing the coating substrate of step (11) through a topcoating curing station located on the coating line to cure the basecoating layer and the clearcoating layer simultaneously. The improvement comprises passing the coated substrate of step (3) directly to a basecoating station located a coating line, sequentially applying in a wet-on-wet application, separate, multiple aqueous basecoating compositions (such as any of the previously described basecoating compositions) directly onto at least a portion of the electrodeposition coating layer, optionally, dehydrating each successive basecoating composition, to form a multilayer basecoating thereon, with no intervening primer-surfacer coating layer between the electrodeposition coating layer and the multilayer basecoating, passing the coated substrate to a clearcoating station located on the coating line, applying a substantially pigment-free coating composition (for example, any of the previously described clear coating compositions) directly onto at least a portion of the multilayer basecoating to form a clearcoating layer thereon, and passing the coated substrate through a topcoating curing station located in the curing line to cure the multilayer basecoating and the clearcoating layer simultaneously.

The invention is also directed to a coating line comprising an electrocoating zone including at least one electrodeposition bath. A basecoat is zone located downstream of and adjacent to the electrocoating zone, the basecoat zone comprising a cut-in station, a first basecoat station, and a second basecoat station. A topcoat zone is located downstream of and adjacent to the basecoat zone.

Illustrating the invention are the following examples which, however, are not to be considered as limiting the invention to their details. All parts and percentages in the following examples as well as throughout the specification are by weight unless otherwise indicated.

EXAMPLES

The following examples illustrate the processes of the present invention. Example A describes the preparation of a medium gray first basecoating composition. Comparative Process Example 1 describes the application (in two coats) of a conventional silver metallic basecoat composition to a cured electrocoat primer, followed by application of a clear coating composition. Process Example 2 describes the process of the present invention wherein the first basecoating composition of Example A is applied to the cured electrocoat primer, followed by application of the conventional silver metallic basecoat and subsequent application of the clear coating composition. Examples B through E describe the preparation of basecoating compositions analogous to that of Example A, but having varying levels of the waterborne polyurethane resin.

Example A

This example describes the preparation of a medium gray base coat composition suitable as the first basecoating composition used to form the first basecoating layer in the process of the present invention. The first basecoating composition was prepared by admixing the following ingredients under mild agitation.

| INGREDIENTS: | Total Weight (Grams) |
|---|---|
| N-butoxy propanol | 15.00 |
| 1-octanol | 5.00 |
| CYMEL 327[1] | 22.22 |
| Phosphatized epoxy resin[2] | 1.63 |
| TINUVIN 1130[3] | 3.00 |
| Deionized water | 10.00 |
| Odorless mineral spirits[4] | 8.00 |
| Acrylic-polyester latex[5] | 41.07 |
| Waterborne polyurethane resin[6] | 39.23 |
| Titanium dioxide paste[7] | 148.76 |
| Carbon black paste[8] | 25.60 |
| SETALUX 6802 AQ-24[9] | 118.75 |
| Dimethyl ethanolamine[10] | 2.86 |
| Deionized water | 37.56 |

[1]Methoxymethyl imino functional melamine-formaldehyde resin available from CYTEC Industries, Inc.

[2]Phosphatized epoxy prepared by reacting EPON 880 (polyglycidyl ether of Bisphenol A available from Shell Chemicals) with phosphoric acid in an 83:17 ratio.

[3]Ultraviolet light stabilizer available from Ciba Specialty Chemicals, Inc.

[4]Available from Shell Oil and Chemical Co.

[5]Latex prepared from 70.6% polyester-acrylic (52.8% 1,6-hexanediol, 27.2% isophthalic acid, 10% adipic acid, 10% maleic anhydride in 66.7% butyl acrylate/33.3% hydroxypropyl methacrylate), 2.4% ethylene glycol dimethacrylate, 20% styrene, 4.7% hydroxypropyl methacrylate, 2.3% acrylic acid, having a solids content of 45% by weight.

[6]Polyurethane resin prepared from 53.8% POLYMEG 2000 (available from BASF), 23.9% isophorone diisocyanate, 6.4% dimethylolpropionic acid, 3.2% adipic acid dihydrazide, 12.7% polyester (54.2% EMPOL 1008 (available from COGNIS-EMERY Group), 29.8% 1,6-hexanediol, 16.1% isophthalic acid, and having a solids content of 39% by weight.

[7]Rutile titanium dioxide (available from E.I. DuPont de Nemours and Company as R 900-39) dispersed in a resin blend of 37.0% waterborne acrylic resin (8.5% hydroxyethyl acrylate, 18.0% butyl methacrylate, 30.0% styrene, 35.0% butyl acrylate, 8.5% acrylic acid made at 27.0% solids), 38.4% acrylic-polyester-urethane latex [3.0% ethylene glycol dimethacrylate, 11.0% methyl methacrylate, 24% butyl acrylate, 2% acrylic acid, and 60% polyester-acrylic-urethane (neopentyl glycol, adipic acid, hydroxyethyl acrylate-butyl acrylate, 1,6-hexamethylene diisocyanate) made at 43.5% solids], and 24.6% polypropylene glycol 425. The dispersion has a 69.5% weight solids content and a pigment to binder ratio of 6.71.

[8]MONARCH 1300 carbon black pigment (available from Cabot) dispersed in 100% aqueous acrylic resin. The dispersion has a 24.1% weight solids content and a pigment to binder ratio of 0.35.

[9]Waterborne acrylic rheology control agent available from Akzo Nobel. This material is supplied at a resin solids content of 24%.

[10]50% dimethyl ethanolamine in deionized water.

The first basecoating composition of Example A was prepared as described above to provide a composition having a weight solids content of 40.9%; a pigment to binder ratio of 0.91; a pH of 8.68; and a #4 DIN Cup viscosity of 35.6 seconds at room temperature.

Comparative Process 1

A conventional silver metallic aqueous basecoat (available from PPG as NHWB-300146) was spray-applied in two coats to coated steel substrate (cold rolled steel B952 P60 D1 coated with PPG ED 5000 electrocoat, available from ACT). The resultant basecoat had a film thickness of 0.59 mils (15 micrometers). Subsequent to application, the silver basecoat was dehydrated for ten minutes at 176° F. (80° C.). A clear coating composition (available from PPG Industries, Inc. as TKU-1050AR) was then spray-applied to the dehydrated silver basecoat. The resultant clear coat had a film thickness of 2.06 mils (52 micrometers). After application of the clear coating composition, the coated substrate was given a room temperature flash period of ten minutes, and then heated to a temperature of 285° F. (140° C.) for thirty minutes.

Process 2

To illustrate the process of the present invention, the medium gray basecoating composition of Example A was spray-applied in one coat to coated steel substrate (cold rolled steel B952 P60 D1 coated with PPG ED 5000 electrocoat, available from ACT) to provide a film thickness of 0.61 mils (15 micrometers). The coated substrate was then given a ninety second room temperature flash period. A conventional silver metallic aqueous basecoat (available from PPG as NHWB-300146) then was spray-applied in one coat. The resultant silver basecoat had a film thickness of 0.35 mils (9 micrometers). Subsequent to application, the silver basecoat was dehydrated for ten minutes at 176° F. (80° C.). A clear coating composition (available from PPG Industries, Inc. as TKU-1050AR) was then spray-applied to the dehydrated silver basecoat. The resultant clear coat had a film thickness of 1.97 mils (50 micrometers). After application of the clear coating composition, the coated substrate was given a room temperature flash period of ten minutes, then heated to a temperature of 285° F. (140° C.) for thirty minutes.

The multilayer composite coatings prepared by the above-described processes were tested as follows. The 200 specular gloss of the resultant multilayer composite coatings was measured using a NOVO GLOSS statistical 20° glossmeter manufactured by GARDCO. Gloss results are reported in values ranging from 0 to 100, with a higher value indicating higher gloss.

The Dorigon Distinctness of Image ("DOI") was measured using a DORIGON II meter manufactured by Hunter Lab. Higher values indicate better DOI. The long wave and short wave values are a measure of the coating surface, i.e., surface topography, smoothness. The BYK wavescan values reported below were measured using a BYK-Gardner WaveScan meter. Lower numbers indicate a smoother surface.

Film hardness was measured using a Fischerscope H100 micro-hardness testing system manufactured by Fischer. The numbers are generated using the DIN 50359 standard method. Hardness values are reported in Newtons/mm$^2$ units. Higher values indicate a harder film. Aluminum flake orientation, and thus change in reflectance with a change in viewing angle, was measured using an ALCOPE LMR-200 Laser Multiple Reflectometer manufactured by Alesco. A higher reported "FF" value indicates better aluminum flake orientation.

Test results are presented in the following Table 1.

TABLE 1

| | | | BYK Wave Scan | | Fischer Micro- | Aluminum |
|---|---|---|---|---|---|---|
| | 20° Gloss | Dorigon DOI | Long Wave | Short Wave | hardness N/mm$^2$ | Orientation FF Value |
| Process 1* | 90 | 90 | 2.2 | 13.9 | 145.7 | 1.65 |
| Process 2 | 92 | 90 | 2.2 | 13.2 | 147.4 | 1.78 |

*Comparative process.

The data presented in Table 1 above illustrate that the process for forming a multilayer composite coating of the present invention provides a multilayer composite coating having at least equivalent or improved aluminum flake orientation.

Light transmittance of two respective multilayer composite coatings formed by the Comparative Process 1 and the process of the present invention, Process 2, were compared as follows. Free films (no steel/electrocoat substrate) were prepared using the respective processes. Coating systems (as described below) were applied to TEDLAR substrates (available from Electrical Insulation Suppliers of Atlanta, Ga.). The free films then were peeled away from the TEDLAR substrate and the percent light transmission was measured through the free paint. The percent transmission data measurements were made using a Perkin Elmer Lambda 9 spectrophotometer with a 150 mm Labsphere integrating sphere in accordance with ASTM E 903-82 "Standard Test Method for Solar Absorptance, Reflectance, and Transmittance of Materials Using Integrating Spheres". Perkin-Elmer UVWinLab software was used for data collection.

The free film prepared using Comparative Process 1 included 0.59 mils (15 micrometers) of NHWB 300146 silver metallic basecoat; and 2.0 mils (51 micrometers) of TKU 1050AR clear coat. The free film prepared using Process 2 included 0.61 mils (15 micrometers) of the basecoating composition of Example A; 0.35 mils (9 micrometers) of NHWB 300146 silver metallic basecoat; and 1.98 mils (50 micrometers) of TKU 1050AR clear coat. The basecoating and clearcoating compositions were applied and processed generally as described above. The percent light transmission for the respective multilayer coating systems measured at various wavelengths can be found in the following Table 2.

TABLE 2

% Light Transmission through Films at Various Wavelengths (nanometers)

| | Wavelength (nm) | | | | |
|---|---|---|---|---|---|
| | 300 | 350 | 400 | 450 | 500 |
| Process 1* | 0 | 0 | 2.03 | 3.01 | 3.06 |
| Process 2 | 0 | 0 | 0 | 0 | 0 |

*Comparative

The data presented in Table 2 above illustrate that the multilayer composite coating prepared using the process of the present invention exhibits 0% light transmission at all wavelengths evaluated, while the composite coating prepared by the comparative process exhibits light transmittance at wavelengths ranging from 400 to 500 nanometers. It would be understood by one skilled in the art that a low percent light transmittance can be related to improved exterior durability because less light reaches the under-layers of a multilayer coating system, such as the less durable electrocoat layer, thereby causing coating layer degradation such as by photo-oxidation.

Examples B-E

The following Examples B to E describe the preparation of medium gray basecoating compositions comprising varying levels polyurethane resin. The composition of Example B comprises 3.1% by weight solids of the polyurethane; the composition of Example C comprises 10.6% by weight solids of the polyurethane; the composition of Example D comprises 18.1 by weight solids of the polyurethane; and the composition of Example E comprises 33.1% by weight solids of the polyurethane. The respective basecoating compositions were prepared by admixing the specified ingredients under mild agitation.

Example B

| INGREDIENTS | Total Weight (Grams) |
|---|---|
| N-butoxy propanol | 15.00 |
| 1-Octanol | 5.00 |
| CYMEL 327 | 22.22 |
| Phosphatized epoxy resin of Example A | 1.63 |
| TINUVIN 1130 | 3.00 |
| Odorless mineral spirits of Example A | 8.00 |
| Acrylic-polyester latex of Example A | 74.53 |
| Polyurethane resin of Example A | 0 |
| Titanium dioxide paste of Example A | 148.76 |
| Carbon black paste of Example A | 25.60 |
| SETALUX 6802 AQ-24 | 118.75 |
| Dimethyl ethanolamine of Example A | 3.46 |
| Deionized water | 63.51 |

The basecoating composition of Example B was prepared to have a 39.96% weight solids; a pigment to binder ratio of 0.92; a pH of 8.69; and a #4 DIN cup viscosity of 34.6 seconds.

Example C

| INGREDIENTS | Total Weight (Grams) |
|---|---|
| N-butoxy propanol | 15.00 |
| 1-Octanol | 5.00 |
| CYMEL 327 | 22.22 |
| Phosphatized epoxy resin of Example A | 1.63 |
| TINUVIN 1130 | 3.00 |
| Odorless mineral spirits of Example A | 8.00 |
| Acrylic-polyester latex of Example A | 57.87 |
| Polyurethane resin of Example A | 19.23 |
| Titanium dioxide paste of Example A | 148.76 |
| Carbon black paste of Example A | 25.60 |
| SETALUX 6802 AQ-24 | 118.75 |
| Dimethyl ethanolamine of Example A | 3.32 |
| Deionized water | 62.85 |

The basecoating composition of Example C was prepared to have 39.82% weight solids; a pigment to binder ratio of 0.92; a pH of 8.70; and a #4 DIN cup viscosity of 33.5 seconds.

Example D

| INGREDIENTS | Total Weight (Grams) |
|---|---|
| N-butoxy propanol | 15.00 |
| 1-Octanol | 5.00 |
| CYMEL 327 | 22.22 |
| Phosphatized epoxy resin of Example A | 1.63 |
| TINUVIN 1130 | 3.00 |
| Odorless mineral spirits of Example A | 8.00 |
| Acrylic-polyester latex of Example A | 41.20 |
| Polyurethane resin of Example A | 38.46 |
| Titanium dioxide paste of Example A | 148.76 |
| Carbon black paste of Example A | 25.60 |
| SETALUX 6802 AQ-24 | 118.75 |
| Dimethyl ethanolamine of Example A | 3.05 |
| Deionized water | 66.03 |

The basecoating composition of Example D was prepared to have 39.38% weight solids; a pigment to binder ratio of 0.92; a pH of 8.71; and a #4 DIN cup viscosity of 32.6 seconds.

Example E

| INGREDIENTS | Total Weight (Grams) |
|---|---|
| N-butoxy propanol | 15.00 |
| 1-Octanol | 5.00 |
| CYMEL 327 | 22.22 |
| Phosphatized epoxy resin of Example A | 1.63 |
| TINUVIN 1130 | 3.00 |
| Odorless mineral spirits of Example A | 8.00 |
| Acrylic-polyester latex of Example A | 7.87 |
| Polyurethane resin of Example A | 76.92 |
| Titanium dioxide paste of Example A | 148.76 |
| Carbon black paste of Example A | 25.60 |
| SETALUX 6802 AQ-24 | 118.75 |
| Dimethyl ethanolamine of Example A | 2.31 |
| Deionized water | 82.94 |

The basecoating composition of Example E was prepared to have 37.76% weight solids; a pigment to binder ratio of 0.92; a pH of 8.67; and a #4 DIN cup viscosity of 26.0 seconds.

The data presented below in Tables 2 shows that the measured physical properties for the multi-layer coatings prepared from the basecoating compositions of Examples B to E described above. The coatings prepared using Process 2 all provide appearance and chip resistance equivalent to coatings made using standard Process 3.

TABLE 2

| Base-coat | | Film Thickness (mils) | | | | BYK Wave Scan | | |
|---|---|---|---|---|---|---|---|---|
| Example | Process # | Base coat | NHWB 300146 | TKU 1050AR | 20° Gloss | Long Wave | Short Wave | Chip Test[b] |
| B | 2 | 0.60 | 0.29 | 1.63 | 91 | 2.9 | 15.6 | 2 |
| C | 2 | 0.64 | 0.30 | 1.63 | 90 | 2.6 | 16.0 | 2 |
| D | 2 | 0.63 | 0.29 | 1.63 | 90 | 2.1 | 15.6 | 2 |
| E | 2 | 0.63 | 0.28 | 1.63 | 89 | 3.2 | 15.4 | 2 |
| — | 3[a] | — | 0.67 | 1.63 | 92 | 3.5 | 18.0 | 2 |

[a]Process # 3 is the same as #1 except for a change in substrate to ACT supplied cold rolled steel C710 C18 DI coated with PPG ED 5000 Electrocoat and 1177225A gray primer surfacer available from PPG Industries, Inc.

[b]The chip testing was done using the Stone Hammer Blow Testing Instrument Model 508 manufactured by ERICHSEN GMBH & CO KG. Five hundred grams of fractured steel shot at 2 Bar Pressure was applied to each test panel twice. A visual rating scale from DIN 55996-1 was used to rate the panels. The Kennwert rating scale is from 0.5 to 5 with lower values indicating better resistance to chipping.

It will be appreciated by those skilled in the art that changes could be made to the embodiments described above without departing from the broad inventive concept thereof. It is understood, therefore, that this invention is not limited to the particular embodiments disclosed, but it is intended to cover modifications which are within the spirit and scope of the invention, as defined by the appended claims.

We claim:

1. A process for forming a multilayer composite coating on a substrate, the process comprising:

forming an electrodeposition coating layer on the substrate by electrodeposition of a curable electrodepositable coating composition over at least a portion of the substrate; optionally, heating the coated substrate to a temperature and for a time sufficient to cure the electrodeposition coating layer;

forming a first basecoating layer on the electrodeposition coating layer by depositing an aqueous curable first basecoating composition comprising an aqueous dispersion of polymeric microparticles directly onto at least a portion of the electrodeposition coating layer, optionally, dehydrating the first basecoating layer;

forming a second basecoating layer on the first basecoating layer by depositing an aqueous curable second basecoating composition, which is the same or different from the first basecoating composition, directly onto at least a portion of the first basecoating layer, optionally, dehydrating the second basecoating layer;

forming a top coating layer on the second basecoating layer by depositing a curable top coating composition which is substantially pigment-free directly onto at least a portion of the second basecoating layer; and curing the top coating layer, the second basecoating layer, the first basecoating layer, and, optionally, the electrodeposition coating layer simultaneously, wherein the percent light transmission through the cured first basecoating layer, the cured second basecoating layer, and the cured top coating layer at a wavelength of from 400 to 500 nm is 3.06%+/−0.05 to 0.10 or less; and wherein the cured second basecoating layer color hides the cured first basecoating layer.

2. The process of claim 1, wherein the first-basecoating composition further comprises:

(i) a first resinous binder, and (ii) a first pigment composition comprising one or more pigments which are dispersed in the first resinous binder.

3. The process of claim 2, wherein the first resinous binder comprises a polymer selected from the group consisting of an acrylic polymer, a polyester polymer, a polyurethane polymer, a polyether polymer, a polyepoxide polymer, a silicon-containing polymer, mixtures thereof, and copolymers thereof.

4. The process of claim 2, wherein the first resinous binder comprises a polyurethane polymer.

5. The process of claim 4, wherein the first pigment composition comprises one or more color-enhancing and/or effect-enhancing pigments.

6. The process of claim 2, wherein the pigment to binder ratio of the first basecoating composition is less than 4.0.

7. The process of claim 2, wherein the pigment to binder ratio of the first basecoating composition ranges from 0.1 to 4.0:1.

8. The process of claim 1, wherein the aqueous dispersion of polymeric microparticles comprises crosslinked polymeric microparticles.

9. The process of claim 1, wherein the first basecoating layer has a cured film thickness of 1 to 50 micrometers.

10. The process of claim 1, wherein the first basecoating layer when cured has 5 percent or less light transmission measured at 400 nanometers at a film thickness of 15 micrometers.

11. The process of claim 10, wherein the first basecoating composition has a pigment to binder ratio of less than 4.0.

12. The process of claim 1, wherein the second basecoating composition is different from the first basecoating composition.

13. The process of claim 12, wherein the second basecoating composition comprises:

(i) a second resinous binder which is the same or different from a first resinous binder; and (ii) a second pigment composition, which is the same or different from a first pigment composition, dispersed in the second resinous binder.

14. The process of claim 13, wherein each of the first and the second resinous binders are the same or different and each comprises a polymer selected from the group consisting of an acrylic polymer, a polyester polymer, a polyurethane polymer, a polyether polymer, a polyepoxide polymer, a silicon-containing polymer, mixtures thereof, and copolymers thereof.

15. The process of claim 14, wherein the first and second resinous binders comprise the same or different polyurethane polymer.

16. The process of claim 15, wherein the first resinous binder comprises a polyurethane polymer having a number average molecular weight ranging from 2,000 to 500,000.

17. The process of claim 14, wherein the concentration of the polyurethane polymer present in the first basecoating composition is less than or equal to the concentration of the polyurethane polymer present in the second basecoating composition, where concentrations are based on total resin solids present in the compositions.

18. The process of claim 13, wherein the second pigment composition comprises one or more color-enhancing and/or effect-enhancing pigments dispersed in the second resinous binder.

19. The process of claim 13, wherein the first basecoating composition further comprises a composition comprising the second pigment composition dispersed in the second resinous binder.

20. The process of claim 19, wherein the first and second basecoating layers are color-harmonized.

21. The process of claim 1, wherein the second basecoating layer has a cured film thickness of 50 micrometers or less.

22. The process of claim 1, wherein the electrodepositable coating composition comprises the electrodepositable coating composition comprising a resinous phase dispersed in an aqueous medium, said resinous phase comprising:

(1) one or more ungelled active hydrogen-containing, cationic amine salt group-containing resins which are electrodepositable on a cathode, said resin comprising cationic amine salt groups derived from pendant and/or terminal amino groups having the following structures (I) or (II):

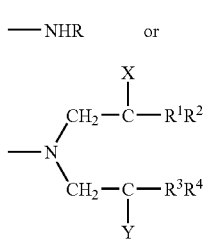

(I)

(II)

wherein the R groups represent H or C1 to C18 alkyl;

R1, R2, R3, and R4 are the same or different, and each independently represents H or C1 to C4 alkyl; and X and Y can be the same or different, and each independently represents a hydroxyl group or an amino group, and (2) one or more at least partially blocked aliphatic polyisocyanate curing agents.

23. The process of claim 22, wherein the cationic amine salt groups of resin (1) are derived from one or more pendant amino groups having the structure (II), such that when the electrodepositable coating composition is electrodeposited and cured, at least two electronwithdrawing groups are bonded in the beta-position relative to substantially all of the nitrogen atoms.

24. The process of claim 23, wherein the electron-withdrawing groups are selected from an ester group, a urea group, a urethane group, and combinations thereof.

25. The process of claim 23, wherein the resin (1) comprises cationic amine salt groups derived from at least one compound selected from ammonia, methylamine, diethanolamine, diisopropanolamine, N-hydroxyethyl ethylene diamine, diethylenetriamine, and mixtures thereof.

26. The process of claim 23, wherein the active hydrogen-containing, cationic amine salt group-containing resin (1) comprises a polymer selected from at least one of a polyepoxide polymer, an acrylic polymer, a polyurethane polymer, a polyester polymer, mixtures thereof, and copolymers thereof.

27. The process of claim 23, wherein the active hydrogen-containing, cationic amine salt group-containing resin (1) comprises a polyepoxide polymer and an acrylic polymer.

28. The process of claim 22, wherein the aliphatic polyisocyanate (2) is at least partially blocked with at least one blocking agent selected from a 1,2-aikane diol, a 1,3-alkade diol, a benzylic alcohol, an allylic alcohol, caprolactam, a dialkylamine, and mixtures thereof.

29. The process of claim 1, wherein the multilayer composite coating has a chip resistance rating of 6 to 10 as determined with ASTM D 3170-01.

30. The process of claim 1, wherein the multilayer composite coating has a chip resistance rating of 4 to 10 as determined in accordance with ASTM D 3170-01.

31. A process for forming a multilayer composite coating on a substrate, the process comprising:

forming an electrodeposition coating layer on the substrate by electrodeposition of a curable electrodepositable coating composition over at least a portion of the substrate;

optionally, heating the coated substrate to a temperature and for a time sufficient to cure the electrodeposition coating layer;

forming a first basecoating layer on the electrodeposition coating layer by depositing an aqueous curable first basecoating composition directly onto at least a portion of the electrodeposition coating layer, the first basecoating composition comprising:

(i) an aqueous dispersion of polymeric microparticles, (ii) a first resinous binder, and (iii) a first pigment composition comprising one or more pigments dispersed in the first resinous binder;

optionally, dehydrating the first basecoating layer;

forming a second basecoating layer on the first basecoating layer by depositing an aqueous curable second basecoating composition directly onto at least a portion of the first basecoating layer, the second basecoating composition comprising:

(i) a second resinous binder which is the same or different from the first resinous binder, and (ii) a second pigment composition, which is different from the first pigment composition, comprising one or more color-enhancing and/or effect-enhancing pigments dispersed in the second resinous binder, optionally, dehydrating the second basecoating layer;

forming a top coating layer on the second basecoating layer by depositing a curable top coating composition which is substantially pigment-free directly onto at least a portion of the second basecoating layer; and wherein the first basecoating composition further comprises a composition comprising the second pigment composition dispersed in the second resinous binder, and wherein the second coating composition has a pigment to binder ratio ranging from 0.1 to 4.0:1, curing the top coating layer, the second basecoating layer, the first basecoating layer, and, optionally, the electrodeposition coating layer simultaneously, and wherein the percent light transmission through the cured first base coating layer, the cured second basecoating layer, and the cured top coating layer at a wavelength of from 400 to 500 nm is 3.06%+/−0.05 to 0.10 or less: and wherein the cured second basecoating layer color hides the cured first basecoating layer.

32. A process for forming a multilayer composite coating on a substrate, the process comprising:

forming an electrodeposition coating layer on the substrate by electrodeposition of a curable electrodepositable coating composition over at least a portion of the substrate;

optionally, heating the coated substrate to a temperature and for a time sufficient to cure the electrodeposition coating layer;

forming a first basecoating layer on the electrodeposition coating layer by depositing an aqueous curable first basecoating composition directly onto at least a portion of the electrodeposition coating layer, the first basecoating composition comprising:

(i) an aqueous dispersion of polymeric microparticles, (ii) a first resinous binder, and (iii) a first pigment composition comprising one or more pigments dispersed in the first resinous binder;

optionally, dehydrating the first basecoating layer;

forming a second basecoating layer on the first basecoating layer by depositing an aqueous curable second basecoating composition directly onto at least a portion of the first basecoating layer, the second basecoating composition comprising:

(i) a second resinous binder which is the same or different from the first resinous binder, and (ii) a second pigment composition, which is different from the first pigment composition, comprising one or more color-enhancing and/or effect-enhancing pigments dispersed in the second resinous binder, optionally, dehydrating the second basecoating layer;

forming a top coating layer on the second basecoating layer by depositing a curable top coating composition which is substantially pigment-free directly onto at least a portion of the second basecoating layer; and curing the top coating layer, the second basecoating layer, the first basecoating layer, and, optionally, the electrodeposition primer coating layer simultaneously, and wherein the percent light transmission through the cured first basecoating layer, the cured second basecoating layer, and the cured top coating layer at a wavelength of from 400 to 500 nm is 3.06%+/−0.05 to 0.10 or less; and wherein the first basecoating layer when cured has 5 percent or less light transmission measured at 400 nanometers at a film thickness of 15 micrometers; and wherein the cured second basecoating layer color hides the cured first basecoating layer.

33. A process for forming a multilayer composite coating on a substrate, the process comprising:

forming an electrodeposition coating layer on the substrate by electrodeposition of a curable electrodepositable coating composition over at least a portion of the substrate;

optionally, heating the coated substrate to a temperature and for a time sufficient to cure the electrodeposition coating layer;

forming a first basecoating layer on the electrodeposition coating layer by depositing an aqueous curable first basecoating composition directly onto at least a portion of the electrodeposition coating layer, the first basecoating composition comprising:

(i) a first resinous binder, and (ii) a first pigment composition comprising one or more pigments dispersed in the first resinous binder;

optionally, dehydrating the first basecoating layer;

forming a second basecoating layer on the first basecoating layer by depositing an aqueous curable second basecoating composition directly onto at least a portion of the first basecoating layer, the second basecoating composition comprising:

(i) a second resinous binder which is the same or different from the first resinous binder, and (ii) a second pigment composition, which is different from the first pigment composition, comprising one or more color-enhancing and/or effect-enhancing pigments dispersed in the second resinous binder, optionally, dehydrating the second basecoating layer;

forming a top coating layer on the second basecoating layer by depositing a curable top coating composition which is substantially pigment-free directly onto at least a portion of the second basecoating layer; and curing the top coating layer, the second basecoating layer, the first basecoating layer, and, optionally, the electrodeposition coating layer simultaneously, wherein the second coating composition has a pigment to binder ratio ranging from 0.1 to 4.0:1, wherein both the first resinous binder and the second resinous binder comprise the same or different polyurethane polymer, wherein the percent light transmission through the cured first basecoating layer, the cured second basecoating layer, and the cured top coating layer at a wavelength of from 400 to 500 nm is 3.06%+/−0.05 to 0.10 or less; and wherein the cured second base coating layer color hides the cured first base coating layer; and wherein the first basecoating composition further comprises a composition comprising the second pigment composition dispersed in the second resinous binder, said composition being admixed with the first basecoating composition immediately prior to deposition of the first basecoating composition directly onto the electrodeposition coating layer.

34. A process for forming a multilayer composite coating on a substrate, the process comprising:

forming an electrodeposition coating layer on the substrate by electrodeposition of a curable electrodepositable coating composition over at least a portion of the substrate;

optionally, heating the coated substrate to a temperature and for a time sufficient to cure the electrodeposition coating layer;

forming a first basecoating layer on the electrodeposition coating layer by depositing an aqueous curable first basecoating composition directly onto at least a portion of the electrodeposition coating layer, the first basecoating composition comprising:

(i) an aqueous dispersion of polymeric microparticles, (ii) a first resinous binder, and (iii) a first pigment composition comprising one or more pigments dispersed in the first resinous binder;

optionally, dehydrating the first basecoating layer;

forming a second basecoating layer on the first basecoating layer by depositing an aqueous curable second basecoating composition directly onto at least a portion of the first basecoating layer, the second basecoating composition comprising:

(i) a second resinous binder which is the same or different from the first resinous binder, and (ii) a second pigment composition, which is different from the first pigment composition, comprising one or more color-enhancing and/or effect-enhancing pigments dispersed in the second resinous binder, optionally, dehydrating the second basecoating layer;

forming a top coating layer on the second basecoating layer by depositing a curable top coating composition which is substantially pigment-free directly onto at least a portion of the second basecoating layer;

curing the top coating layer, the second basecoating layer, the first basecoating layer, and, optionally, the electrodeposition coating layer simultaneously, wherein the first basecoating composition further comprises a composition comprising the second pigment composition dispersed in the second resinous binder, and wherein both the first resinous binder and the second resinous binder comprise the same or different polyurethane polymer, said polyurethane polymer being present in the first basecoating composition at a concentration which is equal to or less than the concentration of the polyurethane polymer present in the second basecoating composition, where concentrations are based on total resin solids present in the first and second basecoating compositions, and wherein the percent light transmission through the cured first basecoating layer, the cured second basecoating layer, and the cured top coating layer at a wavelength of from 400 to 500 nm is 3.06%+/−0.05 to 0.10 or less, and wherein the cured second base coating layer color hides the cured first base coating layer.

35. A method of applying a composite coating over a vehicle substrate, comprising the steps of:

(a) applying an electrodeposited coating over at least a portion of the vehicle substrate;

(b) providing a first aqueous basecoat composition comprising an aqueous dispersion of polymeric microparticles, a first resinous binder and a first pigment composition;

(c) providing a second aqueous basecoat composition comprising a second resinous binder and a second pigment composition, with the second pigment composition being different than the first pigment composition;

(d) applying the second basecoat composition onto the interior cut-in portions of the vehicle substrate;

(e) applying the first basecoat composition onto the electrodeposited coating; and (f) applying the second basecoat composition wet-on-wet directly onto the first basecoat composition with no dehydration of the first basecoat composition, to form a composite basecoat having a first basecoat layer and a second basecoat layer, and wherein the percent light transmission through the cured first basecoating layer, the cured second basecoating layer, and the cured top coating layer at a wavelength of from 400 to 500 nm is 3.06%+/−0.05 to 0.10 or less; and wherein the cured second base coating layer color hides the cured first base coating layer.

36. The method of claim 35, wherein step (e) includes adding a portion of the second basecoat composition to the first basecoat composition to change the pigment composition of the first basecoat composition prior to application of the first basecoat composition over the vehicle substrate.

37. The method of claim 35, including applying the first and second basecoat compositions over the electrodeposited coating without the intervention of a primer surfacer layer.

38. The method of claim 35, including applying the first basecoat composition by at least one bell applicator.

39. The method of claim 35, including applying the second basecoat composition by at least one gun applicator.

40. The method of claim 35, including curing the electrodeposited coating prior to application of the first and second basecoat compositions.

41. The method of claim 35, including heating the electrodeposited coating and composite basecoat to simultaneously cure the electrodeposited coating and composite basecoat.

42. The method of claim 35, including applying a topcoat over the composite basecoat.

43. The method of claim 42, including heating the composite basecoat and topcoat to simultaneously cure the composite basecoat and topcoat.

44. In a process for forming a multilayer composite coating on a motor vehicle substrate comprising the sequential steps of:

(1) passing a conductive motor vehicle substrate to an electrocoating station located on a coating line;

(2) electrocoating the substrate serving as a charged electrode in an electrical circuit comprising said electrode and an oppositely charged counter electrode, said electrodes being immersed in an aqueous electrodepositable composition, comprising passing electric current between said electrodes to cause deposition of the electrodepositable composition on the substrate as a substantially continuous film of electrodeposition coating;

(3) passing the coated substrate of step (2) through an electrodeposition coating curing station located on the coating line to cure the electrodepositable composition on the substrate forming an electrodeposition coating layer thereon;

(4) passing the coated substrate of step (3) to a primer-surfacer coating station located on the coating line;

(5) applying a primer-surfacer coating composition directly to at least a portion of the electrodeposition coating layer to form a primer-surfacer coating layer thereon;

(6) passing the coated substrate of step (5) through a primer-surfacer curing station located on the coating line to cure the primer-surfacer coating layer;

(7) passing the coated substrate of step (6) to a basecoating station located on the coating line;

(8) applying an aqueous basecoating composition directly onto at least a portion of the primer-surfacer coating layer to form a basecoating layer thereon;

(9) optionally, passing the coated substrate of step (8) through a flash oven located on the coating line to dehydrate but not cure the basecoating layer;

(10) passing the coating substrate of step (8), or optionally step (9), to a clearcoating station located on the coating line;

(11) applying a substantially pigment-free coating composition directly onto at least a portion of the basecoating layer to form a clearcoating layer thereon; and

(12) passing the coating substrate of step (11) through a topcoating curing station located on the coating line to cure the basecoating layer and the clearcoating layer simultaneously, the improvement comprising passing the coated substrate of step (3) directly to a basecoating station located a coating line, sequentially applying in a wet-on-wet application, separate multiple aqueous basecoating compositions directly onto at least a portion of the electrodeposition coating layer, with optional dehydration of each successive basecoating layer, to form a multilayer basecoating thereon, with no intervening primer-surfacer coating layer between the electrodeposition coating layer and the multilayer basecoating, passing the coated substrate to a clearcoating station located on the coating line, applying a substantially pigment-free coating composition directly onto at least a portion of the multilayer basecoating to form a clearcoating layer thereon, and passing the coated substrate through a topcoating curing station located in the curing line to cure the multilayer basecoating and the clearcoating layer simultaneously, and wherein the percent light transmission through the cured first basecoating layer, the cured second basecoating layer, and the cured top coating layer at a wavelength of from 400 to 500 nm is 3.06%+/−0.05 to 0.10 or less; and wherein the cured second base coating layer color hides the cured first base coating layer.

45. A process for forming a multilayer composite coating on a substrate, the process comprising:

forming an electrodeposition coating layer on the substrate by electrodeposition of a curable electrodepositable coating composition over at least a portion of the substrate;

optionally, heating the coated substrate to a temperature and for a time sufficient to cure the electrodeposition coating layer;

forming a first basecoating layer on the electrodeposition coating layer by depositing an aqueous curable first basecoating composition directly onto at least a portion of the electrodeposition coating layer, optionally, dehydrating the first basecoating layer;

forming a second basecoating layer on the first basecoating layer by depositing an aqueous curable second basecoating composition, which is the same or different from the first basecoating composition, directly onto at least a portion of the first basecoating layer, optionally, dehydrating the second basecoating layer;

forming a top coating layer on the second basecoating layer by depositing a curable top coating composition which is substantially pigment-free directly onto at least a portion of the second basecoating layer; and curing the top coating layer, the second basecoating layer, the first basecoating layer, and, optionally, the electrodeposition coating layer simultaneously, wherein the first basecoating composition comprises one or more aqueous dispersions of polymeric microparticles prepared from a monomer admixture comprising one or more monomers having two or more sites of reactive ethylenic unsaturation and/or a combination of two different monomers having mutually reactive groups, and wherein the percent light transmission through the cured first basecoating layer, the cured second basecoating layer, and the cured top coating layer at a wavelength of from 400 to 500 nm is 3.06%+/−0.05 to 0.10 or less, and wherein the cured second base coating layer color hides the cured first base coating layer.

46. The process of claim 45, wherein the one or more aqueous dispersions of polymeric microparticles are present in the first basecoating composition in an amount ranging from 20 to 75 weight percent based on total weight of resin solids present in the first basecoating composition.

47. The process of claim 46, wherein the one or more aqueous dispersions of polymeric microparticles are present in the first basecoating composition in an amount ranging from 25 to 70 weight percent based on total weight of resin solids present in the first basecoating composition.

48. The process of claim 46, wherein the one or more aqueous dispersions of polymeric microparticles are present in the first basecoating composition in an amount ranging from 30 to 60 weight percent based on total weight of resin solids present in the first basecoating composition.

49. The process of claim 46, wherein the one or more aqueous dispersions of polymeric microparticles are present in the first basecoating composition in an amount ranging from 35 to 55 weight percent based on total weight of resin solids present in the first basecoating composition.

50. The process of claim 29, wherein the first basecoating composition comprises less than 50 weight percent, based on total weight of resin solids present in the first basecoating composition, of one or more hybrid resinous binders prepared by co-polymerizing one or more polymerizable ethylenically unsaturated monomers in the presence of a polyester polymer.

51. The process of claim 29, wherein the first basecoating composition and the second basecoating composition each comprise one or more polyurethane resins, wherein the concentration of the one or more polyurethane resins present in the first basecoating composition is less than or equal to the concentration of the one or more polyurethane resins present in the second basecoating composition.

52. The process of claim 29, wherein the first basecoating composition comprises less than 50 weight percent, based on total weight of resin solids present in the first basecoating composition, of one or more hybrid resinous binders prepared by co-polymerizing one or more polymerizable ethylenically unsaturated monomers in the presence of a polyester polymer, and the first basecoating composition and the second basecoating composition each comprise one or more polyurethane resins, such that the concentration of the one or more polyurethane resins present in the first basecoating composition is less than or equal to the concentration of the one or more polyurethane resins present in the second basecoating composition.

53. A process for forming a multilayer composite coating on a substrate, the process comprising:

forming an electrodeposition coating layer on the substrate by electrodeposition of a curable electrodepositable coating composition over at least a portion of the substrate;

optionally, heating the coated substrate to a temperature and for a time sufficient to cure the electrodeposition coating layer;

forming a first basecoating layer on the electrodeposition coating layer by depositing an aqueous curable first basecoating composition directly onto at least a portion of the electrodeposition coating layer, optionally, dehydrating the first basecoating layer;

forming a second basecoating layer on the first basecoating layer by depositing an aqueous curable second basecoating composition, which is the same or different from the first basecoating composition, directly onto at least a portion of the first basecoating layer, optionally, dehydrating the second basecoating layer;

forming a top coating layer on the second basecoating layer by depositing a curable top coating composition which is substantially pigment-free directly onto at least a portion of the second basecoating layer; and curing the top coating layer, the second basecoating layer, the first basecoating layer, and, optionally, the electrodeposition coating layer simultaneously, wherein the first basecoating composition further comprises a first pigment composition and the second base coating composition further comprises a second pigment composition, the second pigment composition being different from the first pigment composition, and wherein the percent light transmission through the cured first basecoating layer, the cured second base coating layer, and the cured top coating layer at a wavelength of from 400 to 500 nm is 0%+/−0.05 to 0.10 or less; and wherein the cured second base coating layer color hides the cured first base coating layer.

* * * * *